US012239159B2

(12) United States Patent
Kleppen

(10) Patent No.: US 12,239,159 B2
(45) **Date of Patent: *Mar. 4, 2025**

(54) INTERFACE FOR SMOKABLE ELEMENT TO CONNECT TO A SMOKE AND/OR TAR FILTER AND RELATED METHODS

(71) Applicant: Filter420, LLC, Seattle, WA (US)

(72) Inventor: Lane Kleppen, Seattle, WA (US)

(73) Assignee: Filter420, LLC, Seattle, WA (US)

( * ) Notice: Subject to any disclaimer, the term of this patent is extended or adjusted under 35 U.S.C. 154(b) by 545 days.

This patent is subject to a terminal disclaimer.

(21) Appl. No.: 17/547,708

(22) Filed: Dec. 10, 2021

(65) Prior Publication Data

US 2022/0142239 A1 May 12, 2022

Related U.S. Application Data

(63) Continuation of application No. 16/168,373, filed on Oct. 23, 2018, now Pat. No. 11,219,242.

(60) Provisional application No. 62/683,607, filed on Jun. 11, 2018.

(51) Int. Cl.

| | |
|---|---|
| ***A24F 7/04*** | (2006.01) |
| ***A24D 3/02*** | (2006.01) |
| ***A24D 3/04*** | (2006.01) |
| ***A24D 3/18*** | (2006.01) |
| ***A24F 13/06*** | (2006.01) |

(52) U.S. Cl.

CPC ..... *A24D 3/0275* (2013.01); *A24D 3/04* (2013.01); *A24D 3/18* (2013.01); *A24F 7/04* (2013.01); *A24F 13/06* (2013.01)

(58) Field of Classification Search

CPC ..... A24F 13/02; A24F 13/04; A24F 13/06; A24D 3/18

See application file for complete search history.

(56) References Cited

U.S. PATENT DOCUMENTS 394,575 A * 12/1888 James ..... A24F 13/06 131/207
1,212,590 A * 1/1917 Waigand ..... A24F 13/04 251/304
3,292,635 A * 12/1966 Kolodny ..... A24F 13/06 131/210

(Continued)

OTHER PUBLICATIONS

Non-Final Office Action received for U.S. Appl. No. 16/168,373 dated Oct. 6, 2020, 24 pages.

(Continued)

*Primary Examiner* — Eric Yaary

(74) *Attorney, Agent, or Firm* — Amin, Turocy & Watson, LLP

(57) ABSTRACT

Various structures for interfaces for a smokable element to connect to a smoke and/or tar filter, and related methods, are provided. For example, the structures and methods enable repeatably and securely connecting or interfacing a smokable element, e.g., an herbal joint, to an air filter, e.g., a smoke and/or tar filter. For instance, an interface can have a horn-shaped end with a deformable opening that receives a smokable element, creating at least a partial seal between the deformable opening of the horn-shaped end and the smokable element. Also, the other end of the interface can have a round end that attaches to an air filter.

20 Claims, 35 Drawing Sheets

(56) References Cited

U.S. PATENT DOCUMENTS

| | | | | |
|---|---|---|---|---|
| 4,209,026 | A * | 6/1980 | Dock | A24F 13/06 131/187 |
| 4,250,900 | A * | 2/1981 | Campbell | A24F 13/12 131/189 |
| 5,826,786 | A | 10/1998 | Dickert | |
| 11,219,242 | B2 * | 1/2022 | Kleppen | A24D 3/18 |
| 2016/0007649 | A1 | 1/2016 | Sampson et al. | |
| 2018/0192692 | A1 | 7/2018 | Richmond et al. | |
| 2019/0124974 | A1 | 5/2019 | Dimmick et al. | |
| 2020/0221762 | A1 | 7/2020 | Kaljura et al. | |

OTHER PUBLICATIONS

Adel, A., "Thibault Square: Lunch in downtown Cape Town", retrieved from https://capetowncollectables.wordpress.com/2011 /12/ 03/thibault-square-lunch-in-downtown-cape-town/, Feb. 6, 2013, 10 pages.

* cited by examiner

INTERFACE FOR SMOKABLE ELEMENT TO CONNECT TO A SMOKE AND/OR TAR FILTER AND RELATED METHODS

RELATED APPLICATIONS

The subject patent application is a continuation of, and claims priority to, U.S. patent application Ser. No. 16/168,373 (now U.S. Pat. No. 11,219,242), filed Oct. 23, 2018, and entitled "INTERFACE FOR SMOKABLE ELEMENT TO CONNECT TO A SMOKE AND/OR TAR FILTER AND RELATED METHODS," which applications claim priority to U.S. Provisional Patent Application No. 62/683,607, filed Jun. 11, 2018, and entitled "Interface for Smokable Element to Connect to a Smoke and/or Tar Filter, and Related Methods," the entireties of which priority applications are hereby incorporated by reference herein.

TECHNICAL FIELD

The subject application relates generally to various embodiments of an interface for a smokable element to connect to a smoke and/or tar filter and related methods.

BACKGROUND

When consuming a smokable element, such as one or more herbs encapsulated with a rolling paper, e.g., an herbal joint, an air filter, e.g., a smoke and/or tar filter, can be utilized to remove various undesirable particles, such as heavy tar particles, prior to inhalation; however, whether hand-made or commercially sold, herbal joints tend not to comprise any additional smoke and/or tar filter. In this regard, a typical tobacco air filter that comes as part of a cigarette is thrown away after use, and thus as an added deficiency, conventional air filters tend not to be easily detachable or reusable.

SUMMARY

This Summary is provided to introduce a selection of representative concepts in a simplified form that are further described below in the Detailed Description. This Summary is not intended to identify key features or essential features of the claimed subject matter, nor is it intended to be used in any way that would limit the scope of the claimed subject matter.

Various repeatable and secure ways to connect or interface a smokable element, e.g., an herbal joint, to an air filter, e.g., a smoke and/or tar filter, and related methods, are described herein.

In an example embodiment, an article of manufacture comprises a continuous channel defining a hollow inner chamber of the article of manufacture extending from a first opening at a first end of the article of manufacture to a second opening at or near a second end of the article of manufacture located opposite the first end. The first end of the article of manufacture is slidably insertable into a third opening of a third end of an air filter, resulting in a seal, between the first end of the article of manufacture and the third end of the air filter, that at least substantially restricts a flow of air, between the first end of the article of manufacture and the third end of the air filter, to the first opening.

In an embodiment, the second end of the article of manufacture can be squeezable at the second end to deform a first shape of the second opening of the second end to a second shape, wherein the first shape of the second opening is different from a third shape of a fourth end of an external object and resists a substantially sealable insertion of the fourth end of the external object into the second opening. Further, the second shape of the second opening can be at least similar to the third shape of the fourth end of the external object, thereby permitting the substantially sealable insertion of the fourth end of the external object into the second opening.

As another option, the second end of the article of manufacture can be deformable at the second end to deform a first shape of the second opening of the second end to a second shape, wherein the first shape of the second opening is different from a third shape of a fourth end of an external object. In this example embodiment, the first shape enables a first amount of insertion of the fourth end of the external object into the second opening, and the second shape enables a second amount of insertion (greater than the first amount) of the fourth end of the external object into the second opening.

The seal can be a first seal that at least substantially restricts a first flow of air between the first end and the third end, and optionally, the first shape is an oblong shape or an oval shape, and the second shape and the third shape are substantially circular, enabling a second seal, between the fourth end of the external object and the second end, that at least substantially restricts a second flow of air, between the fourth end and the second end, to the second opening.

The first end and/or the second end of the article of manufacture can comprise an elastomeric material.

Optionally, a second area defined by the second opening of the second end is larger than a first area defined by the first opening of the first end. Also, the first end of the article of manufacture can be larger than the third opening of the third end of the air filter, and the first end of the article of manufacture is affixed to the third opening of the third end of the air filter via an interference fit.

In example embodiments, the article of manufacture is cone-shaped or horn-shaped, with a circumference of the second opening increasing in the channel towards the second end, and a cross section of the first end of the article of manufacture, taken orthogonally to an insertion direction of the first end into the third end, is a circular cross section.

In an embodiment, the seal between the first end of the article of manufacture and the third end of the air filter completely restricts the flow of air, between the first end of the article of manufacture and the third end of the air filter, to the first opening.

In another example embodiment, the seal is a first seal that at least substantially restricts a first flow of air between the first end and the third end, and a second seal, formed between the fourth end of the external object and the second end of the article of manufacture after insertion of the fourth end into the second end, completely restricts a second flow of air, between the fourth end and the second end, to the second opening.

In still another example embodiment, the seal is a first seal that at least substantially restricts a first flow of air between the first end and the third end, and wherein a second seal, formed between the fourth end of the external object and the second end of the article of manufacture after insertion of the fourth end into the second end, partially restricts a second flow of air, between the fourth end and the second end, to the second opening and enables at least a third flow of external air to be received through the second opening and conveyed to the first opening along with the second flow of air.

In yet still other example embodiments, an amount of the third flow of external air is adjustable, and the air filter can be a smoke and/or tar filter.

An example method comprises removably inserting, into a circular opening of a smoke and tar filter, a first circular end of an interface to a smokable element, resulting in a first air seal between an outside of the first circular end of the interface to the smokable element and the smoke and tar filter. In this regard, the interface to the smokable element comprises a continuous internal channel defining a hollow chamber for at least partially receiving the smokable element via an opening of a second end of the interface to the smokable element.

The method further comprises removably receiving, into the opening of the second end of the interface to the smokable element, a smokable end of the smokable element, wherein the smokable end is opposite the first circular end. In this regard, at least a portion of the continuous internal channel at the smokable end defines a baffle into which the smokable end of the smokable element is insertable resulting in at least a substantial restriction of air flowing into the continuous internal channel, other than smoke received in the continuous internal channel from the smokable end of the smokable element.

The removably receiving can comprise receiving an application of a squeezing force by the baffle that results in a deformation of a first geometry of the baffle to match or substantially match a second geometry of the smokable end of the smokable element, and receiving a release of the application of the squeezing force after the smokable end has been received into the opening of the second end of the interface to the smokable element.

Furthermore, the removably receiving results in the smokable end being press fit within the baffle, and further results in a second air seal between an outside of the smokable end and the second end.

The method can further comprise re-applying the squeezing force to the baffle to result in the deformation, thereby enabling the smokable end of the smokable element to be removed by terminating the press fit within the baffle.

The method can further comprise applying a twisting force to the baffle, thereby enabling the smokable end of the smokable element to be removed by terminating the press fit within the baffle.

In one embodiment, the second end of the interface to the smokable element is comprised of at least two hinged-flaps, and the removably receiving comprises receiving a first application of force first moving the at least two hinged-flaps, wherein the receiving the first application of force results in the deformation of the first geometry of the baffle to match or substantially match the second geometry of the smokable end of the smokable element. The removably receiving can further comprise receiving a second application of force second moving the at least two hinged-flaps after the smokable end has been received into the second end of the interface to the smokable element, wherein the receiving the second application of force results in the smokable end being press fit within the baffle, and further results in the second air seal between the outside of the smokable end and the second end.

In another example embodiment, the second end of the interface to the smokable element is comprised of at least two hinged-flaps, and the at least two hinged-flaps are secured in place by a first ring that is slidably movable along the length of the interface to the smokable element. For instance, the first ring may snuggly fits around the exterior of the second end of the interface to the smokable element resulting in the at least two hinged flaps being substantially immovable. In this embodiment, the removably receiving can comprise receiving the first application of force first sliding the ring away from the second end of the interface to the smokable element toward the first end of the interface to the smokable element, wherein the receiving the first application of force results in the at least two hinged-flaps being movable. The removably receiving can further comprise receiving a second application of force first moving the at least two hinged-flaps, wherein the receiving the second application of force results in the deformation of the first geometry of the baffle to match or substantially match the second geometry of the smokable end of the smokable element.

The removably receiving can further comprise receiving a third application of force second moving the at least two hinged-flaps after the smokable end has been received into the second end of the interface to the smokable element, wherein the receiving the third application of force results in the smokable end being press fit within the baffle, and further results in the second air seal between the outside of the smokable end and the second end. The removably receiving can still further comprise receiving a fourth application of force second sliding the ring toward the second end of the interface to the smokable element, wherein the receiving the fourth application of force results in the at least two hinged-flaps being substantially immovable.

In an example embodiment, the at least two hinged-flaps are securable by at least one clip that is removably attachable to the second end of the interface to the smokable element, wherein, when the at least one clip is attached to the at least two hinged flaps, the at least two hinged flabs are in a substantially immovable first configuration. In this embodiment, the removably receiving comprises receiving a first application of force detaching the at least one clip from the second end of the interface to the smokable element, wherein the receiving the first application of force results in the at least two hinged-flaps being changed to a movable second configuration. The removably receiving can further comprise receiving a second application of force first moving the at least two hinged-flaps, wherein the receiving the second application of force results in the deformation of the first geometry of the baffle to match or substantially match the second geometry of the smokable end of the smokable element.

The removably receiving can further comprise receiving a third application of force second moving the at least two hinged-flaps after the smokable end has been received into the second end of the interface to the smokable element, wherein the receiving the third application of force results in the smokable end being press fit within the baffle, and further results in the second air seal between the outside of the smokable end and the second end. The removably receiving can still further comprise receiving a fourth application of force removably attaching the at least one clip to the second end of the interface to the smokable element, wherein the receiving the fourth application of force results in the at least two hinged-flaps being changed to a substantially immovable third configuration.

In yet another example embodiment, the second air seal partially restricts a first flow of external air of the air flowing into the continuous internal channel, other than a second flow of smoke air of the smoke received in the continuous internal channel from the smokable end of the smokable element, enabling a portion of the first flow of external air to be received through the opening of the second end of the interface to the smokable element, along with the second flow of smoke air. Thus, a mixture of the first flow of external air and the second flow of smoke air is conveyed to the first circular end of the interface to the smokable element.

Optionally, an amount that the second air seal partially restricts the first flow of external air is adjustable.

As yet still another embodiment, a twistable knob member is rotatably affixed to the interface to the smokable element, and wherein the removably receiving comprises receiving an application of a twisting force to the twistable knob member that results in the deformation of the first geometry of the baffle to match or substantially match the second geometry of the smokable end of the smokable element. The removably receiving can further comprise releasing the application of the twisting force after the smokable end has been received into the opening of the second end of the interface to the smokable element. In this regard, the releasing of the application of the twisting force results in the smokable end being press fit within the baffle, and further results in the second air seal between the outside of the smokable end and the second end.

As other options, a cross section of the opening of the second end of the interface to the smokable element is star-shaped, ovular, or substantially rectangular.

In another example embodiment, an apparatus comprises first attachment means for attaching a first end of a continuous channel of the apparatus to an end of an air filter and for creating a first seal between an outside of the first end of the continuous channel and the end of the air filter. In this regard, the continuous channel defines a hollow inner chamber of the apparatus extending from a first opening at the first end of the continuous channel to a second opening at or near a second end of the continuous channel, and the second end is located opposite the first end. Further, the first seal at least partially restricts a first flow of air, flowing directionally from the continuous channel to the air filter, to the first opening.

The apparatus further comprises second attachment means for attaching to an end of an external object at the second opening at or near the second end of the continuous channel, and for creating a second seal between an outside of the end of the external object and the second opening at or near the second end of the continuous channel. In this regard, the second seal at least partially restricts a second flow of air, flowing directionally from the external object to the continuous channel, to the second opening.

The following description and the drawings set forth certain illustrative aspects of the specification. These aspects are indicative, however, of but a few of the various ways in which the principles of the specification may be employed. Other advantages and novel features of the specification will become apparent from the detailed description of the specification when considered in conjunction with the drawings.

DETAILED DESCRIPTION

Figure 1:
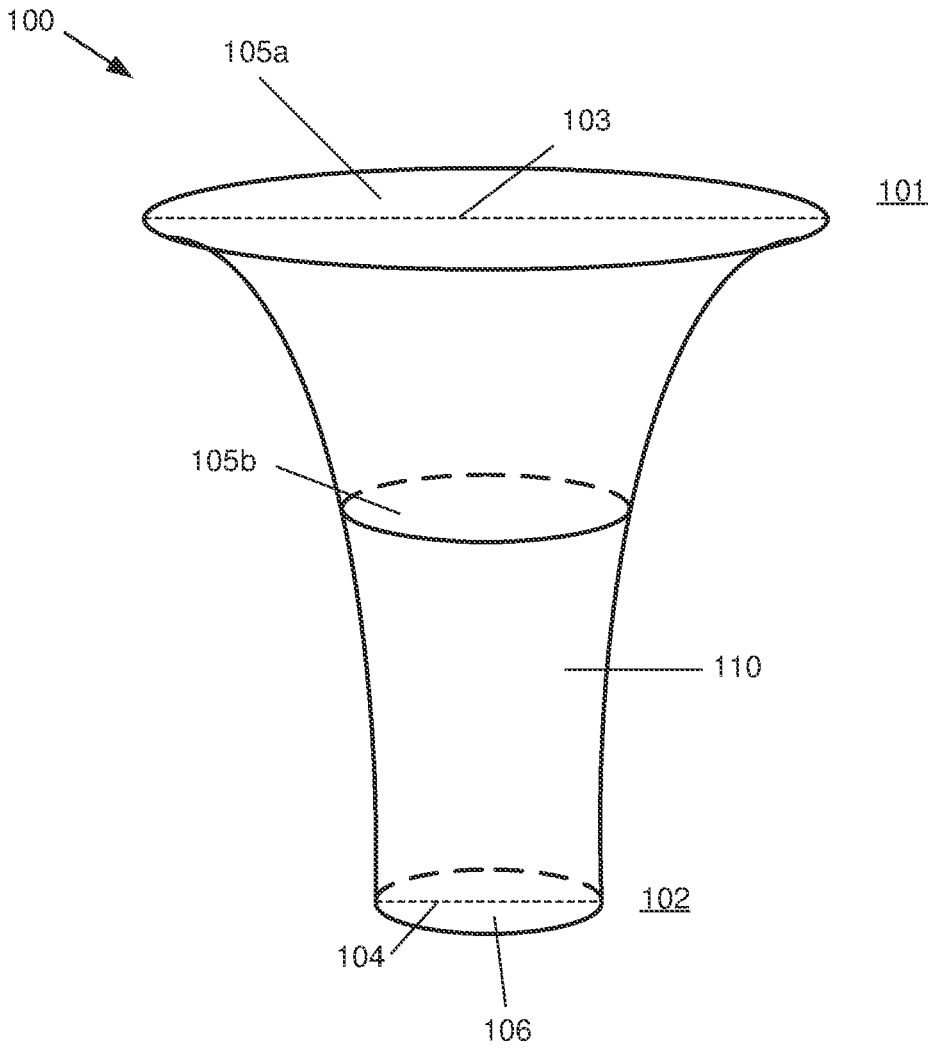
FIG. 1 illustrates a perspective view of the interface with a horn-shaped end for reception of a smokable element, in accordance with disclosed embodiments.

One or more embodiments are now described with reference to the drawings, wherein like reference numerals are used to refer to like elements throughout. In the following description, for purposes of explanation, numerous specific details are set forth in order to provide a thorough understanding of the various embodiments. It may be evident, however, that the various embodiments can be practiced without these specific details, e.g., without applying to any particular networked environment or standard. In other instances, well-known structures and devices are shown in block diagram form in order to facilitate describing the embodiments in additional detail.

In addition, the word "example" or "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As mentioned, various embodiments are described herein of an interface that enables connection, and disconnection, of an air filter to a smokable element via the interface in a reusable fashion, or to related methods for interfacing the smokable element, e.g., an herbal joint, to the air filter, e.g., a smoke and/or tar filter. Beneficially, the smokable element can be securely and repeatedly interfaced to, or connected with, the air filter. For example, interfacing between the air filter and smokable elements can comprise removably inserting the smokable element into the interface at one end, where the interface at the other end is attached to the air filter that allows unwanted particles to be filtered when the smokable element is being consumed.

In this regard, and now referring to FIG. 1, a perspective view 100 of an interface 110 with a horn-shaped end 101 for reception of a smokable element, such as an herbal joint (not pictured) is illustrated. In this example embodiment, the interface 110 comprises the horn-shaped end 101 with a circular opening 105*a*, and a round end 102 with a circular opening (not pictured), where the horn-shaped end 101 and the round end 102 are opposite each other. In this example, the diameter 103 of the horn-shaped end 101 is larger than the diameter (not pictured) of the round end 102. It is noted that the smokable element, to be received by interface 110 at the horn-shaped end 101, may actually be received farther into the horn-shaped end 101 than the circular opening 105*a*. For example, if an end of the smokable element is smaller than circular opening 105*a*, then the smokable element will be insertable to a point inside the horn-shaped end 101, e.g., to circular opening 105*b* as an alternative since the horn-shaped end narrows as the smokable element is inserted to eventually match or substantially match structural geometries to form or substantially form a seal there between, as described in a variety of further embodiments below. To further illustrate the point, and for the avoidance of doubt, the smokable element could be received to a point between circular opening 105*a* and circular opening 105*b* as well, wherever the smokable element abuts the inside of the interface 110 via the horn-shaped end 101, e.g., forms a seal, or substantial seal, with the inside of the horn-shaped end 101.

Figure 2:
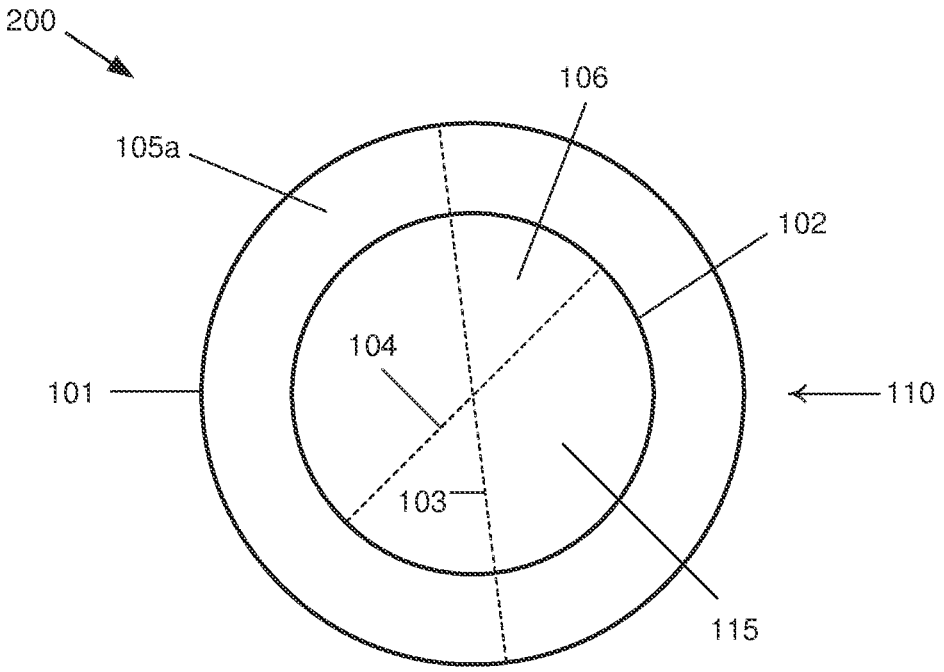
FIG. 2 illustrates a top view of the interface with a horn-shaped end for reception of a smokable element, in accordance with disclosed embodiments.

Now referring to FIG. 2, a top view 200 of the interface 110 with the horn-shaped end 101 for reception of a smokable element (not pictured) is illustrated. In FIG. 2, the circular opening 105*a* is defined by the diameter 103 and the circular opening 106 is defined by the diameter 104, as shown. The interface 110 comprises the horn-shaped end 101 with the circular opening 105*a* and the round end 102 with the circular opening 106, where the horn-shaped end 101 and the round end 102 are opposite each other, where the diameter 103 of the horn-shaped end 101 is larger than the diameter 104 of the round end 102, where the diameter 103 of the circular opening 105*a* on the horn-shaped end 101 is larger than the diameter 104 of the circular opening 106 on the round end 102, and where the circular opening 105 of the horn-shaped end 101 has a cross-sectional shape 115. In FIG. 2, and as mentioned, this cross-sectional shape 115 can be circular, as shown, but it can also be any other shape suited to the carriage of air, such as star-shaped, rectangular, square, polygonal, U-shaped, etc.

Figure 3:
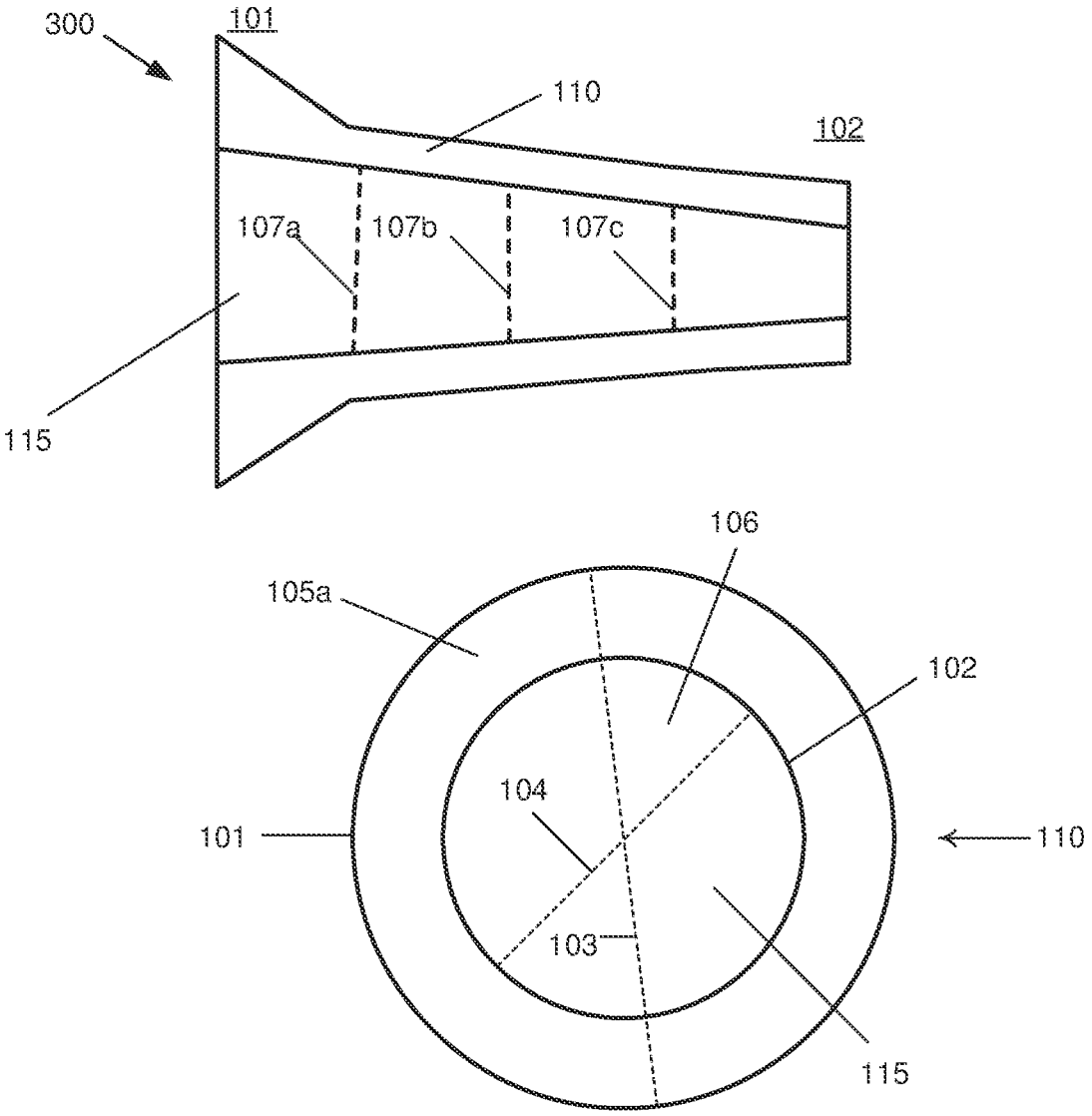
FIG. 3 illustrates a cross sectional view of the interface with a horn-shaped end for reception of a smokable element, and an opening with circular cross sections, in accordance with disclosed embodiments.

Now referring to FIG. 3, a cross sectional view 300 of the interface 110 with a horn-shaped end 101 for reception of a smokable element (not pictured) is illustrated. In FIG. 3, the circular opening 105*a* is defined by the diameter 103 and the circular opening 106 is defined by the diameter 104, as shown. The interface 110 comprises the horn-shaped end 101 with the circular opening 105*a* and the round end 102 with the circular opening 106, where the horn-shaped end 101 and the round end 102 are opposite each other, where the diameter 103 of the horn-shaped end 101 is larger than the diameter 104 of the round end 102, where the diameter 103 of the circular opening 105*a* on the horn-shaped end 101 is larger than the diameter 104 of the circular opening 106 on the round end 102, where the circular opening 105 of the horn-shaped end 101 has a cross-sectional shape 115, and where the diameter 107 of the opening becomes increasingly larger moving away from the round end 102. In FIG. 3, the increase in the diameter 107 is shown by diameters 107*a*, 107*b*, and 107*c*. In FIG. 3, and as mentioned, this cross-sectional shape 115 can be circular, as shown, but it can also be any other shape suited to the carriage of air, such as star-shaped, rectangular, square, polygonal, U-shaped, etc.

Figure 4:
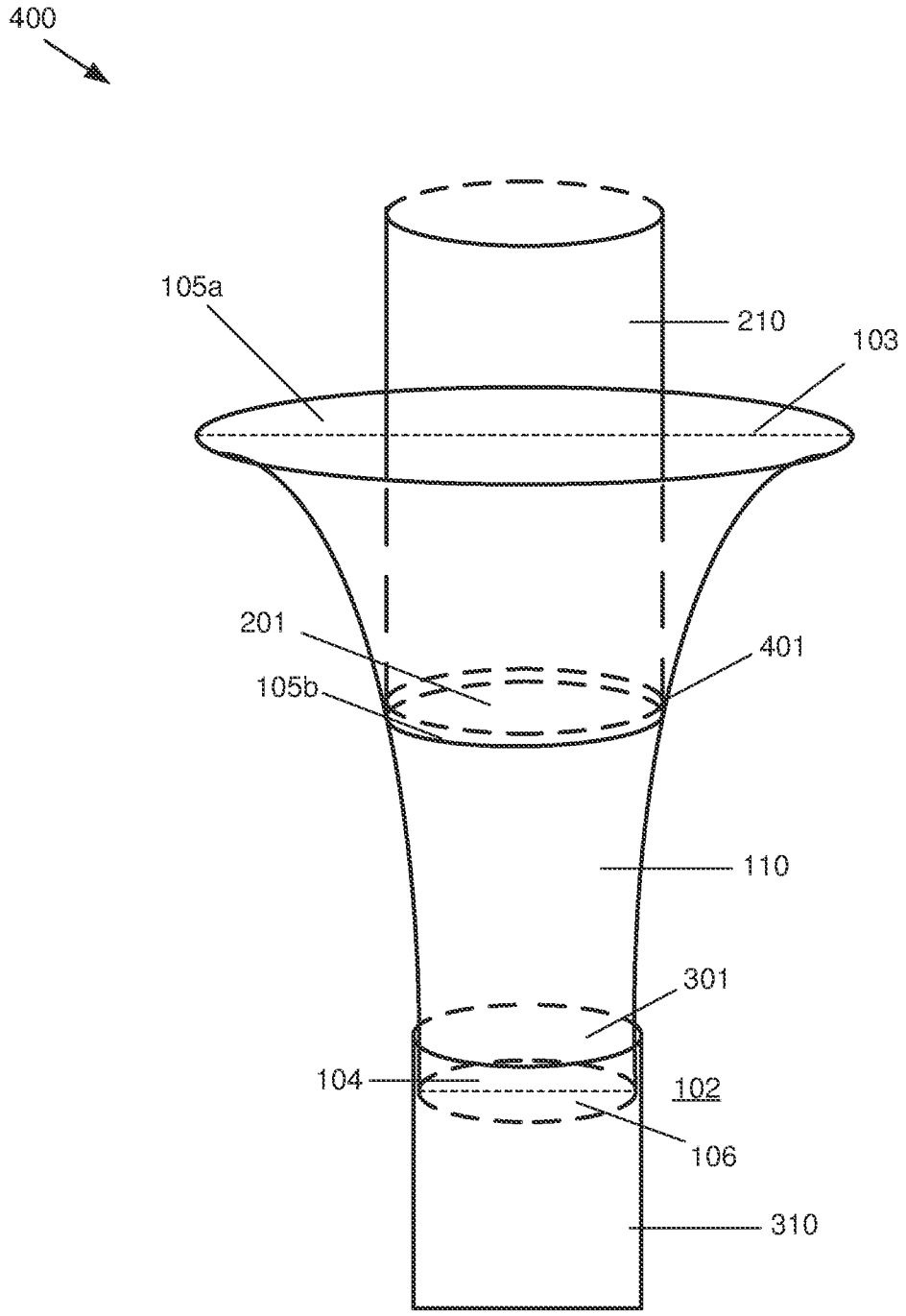
FIG. 4 illustrates a perspective view of the interface with a horn-shaped end for reception of a smokable element, when affixed to an air filter and a smokable element is inserted, in accordance with disclosed embodiments.

Now referring to FIG. 4, a perspective view 400 of the interface 110 with a horn-shaped end 101 for reception of a smokable end 201 of a smokable element 210, where the round end 102 of the interface 110 is affixed 404 to a circular opening 301 of an air filter 310, and where the smokable element 210 is inserted 401 into the circular opening 105 of the horn-shaped end 101 of the interface 110 is illustrated. It is noted that the smokable element 210, to be received by interface 110 at the horn-shaped end 101, may actually be received farther into the horn-shaped end 101 than the circular opening 105*a*. For example, if the smokable end 201 of the smokable element 210 is smaller than circular opening 105*a*, then the smokable element 210 will be insertable to a point inside the horn-shaped end 101, e.g., to circular opening 105*b* as an alternative since the horn-shaped end narrows as the smokable element 210 is inserted to eventually match or substantially match structural geometries to form or substantially form a seal there between, as described in a variety of further embodiments below. To further illustrate the point, and for the avoidance of doubt, the smokable element 210 could be received to a point between circular opening 105*a* and circular opening 105*b* as well, wherever the smokable element 210 abuts the inside of the interface 110 via the horn-shaped end 101, e.g., forms a seal, or substantial seal, with the inside of the horn-shaped end 101.

Figure 5:
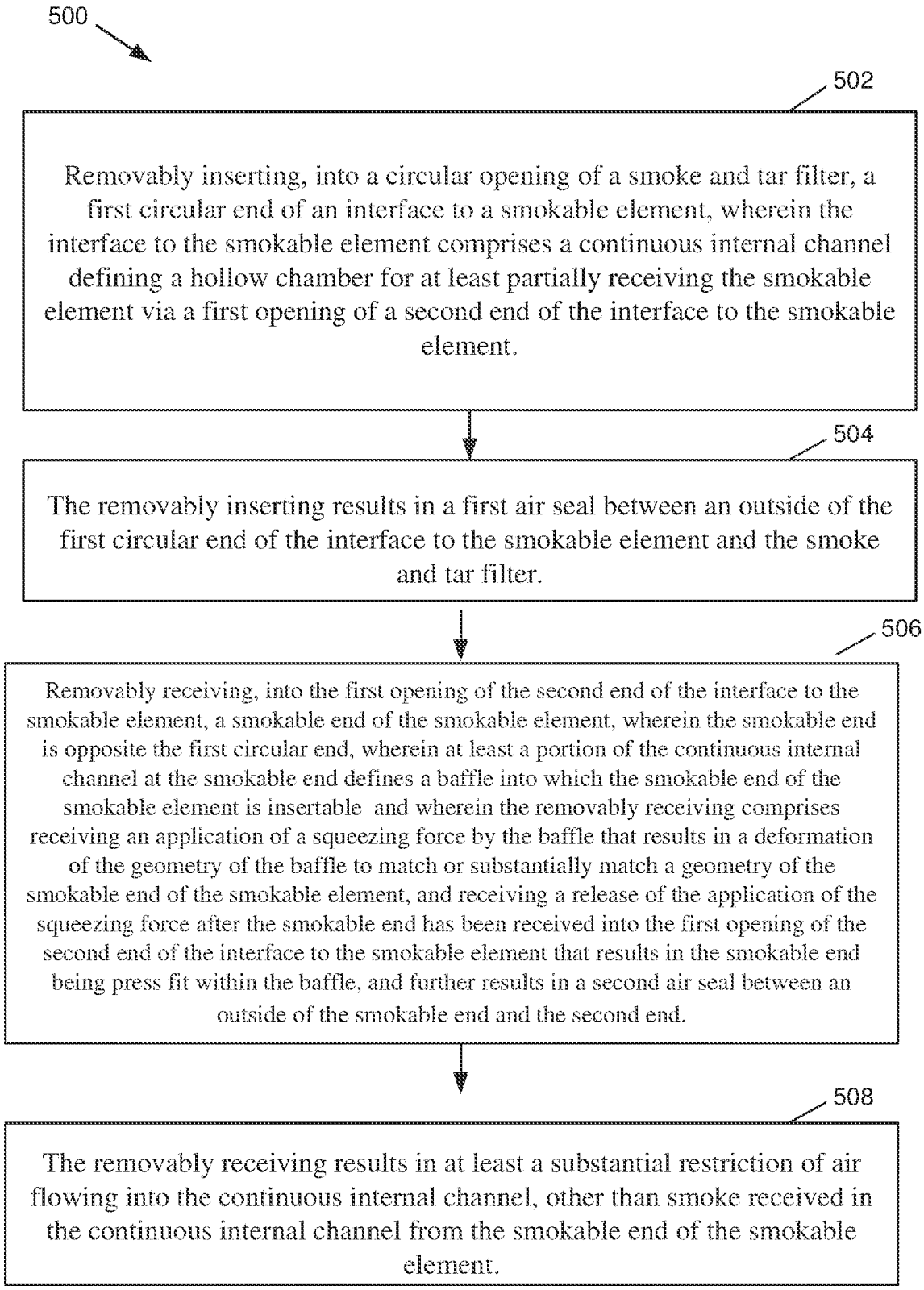
FIG. 5 illustrates a flowchart of a method for inserting a smokable element into the interface, in accordance with disclosed embodiments.

Now referring to FIG. 5, a flowchart 500 of a method for inserting a smokable element into the circular opening of the horn-shaped end of the interface is illustrated. The method 500 comprises: at 502, removably inserting, into a circular opening of a smoke and tar filter, a first circular end of an interface to a smokable element, resulting, at 504, in a first air seal between an outside of the first circular end of the interface to the smokable element and the smoke and tar filter, wherein the interface to the smokable element comprises a continuous internal channel defining a hollow chamber for at least partially receiving the smokable element via a first opening of a second end of the interface to the smokable element.

At 506, the method comprises removably receiving, into the first opening of the second end of the interface to the smokable element, a smokable end of the smokable element, wherein the smokable end is opposite the first circular end. Further, at least a portion of the continuous internal channel at the smokable end defines a baffle into which the smokable end of the smokable element is insertable resulting in at least a substantial restriction of air flowing into the continuous internal channel, other than smoke received in the continuous internal channel from the smokable end of the smokable element. Also, the removably receiving comprises receiving an application of a squeezing force by the baffle that results in a deformation of the geometry of the baffle to match or substantially match a geometry of the smokable end of the smokable element, and receiving a release of the application of the squeezing force after the smokable end has been received into the first opening of the second end of the interface to the smokable element that results in the smokable end being press fit within the baffle, and further results in a second air seal between an outside of the smokable end and the second end.

At 508, it is noted that the removably receiving results in at least a substantial restriction of air flowing into the continuous internal channel, other than the smoke received in the continuous internal channel from the smokable end of the smokable element.

Figure 6:
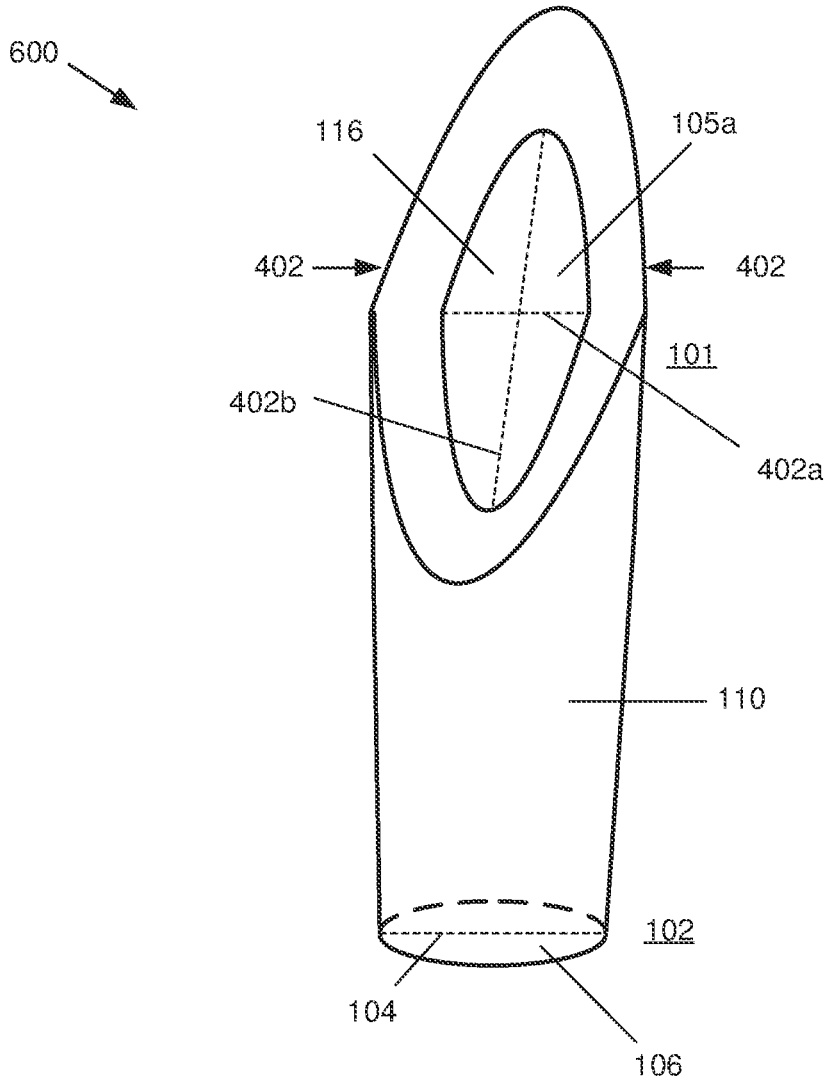
FIG. 6 illustrates a perspective view of the interface with a horn-shaped end for reception of a smokable element, when a squeezing force is applied to the horn-shaped end, in accordance with disclosed embodiments.

Now referring to FIG. 6, a perspective view 600 of the interface 110 with a circular opening 105*a* of the horn-shaped end 101 for reception of a smokable element (not pictured), where a squeezing force 402 is applied to the horn-shaped end 101 of the interface 110, resulting in a deformation of the first cross-sectional shape (not pictured) of the circular opening 105*a* to a second cross-sectional shape 116 which allows for insertion of the smokable end (not pictured) of the smokable element (not pictured) into the deformed circular opening 105*a* of the horn-shaped end 101 of the interface 110 is illustrated. In FIG. 6, the resulting second cross-sectional shape is defined by a first distance 402*a* between the edges of the second cross-sectional shape at the points where the squeezing force 402 is applied and a second distance 402*b* between the edges of the second cross-sectional shape at the points perpendicular to the squeezing force 402.

Figure 7:
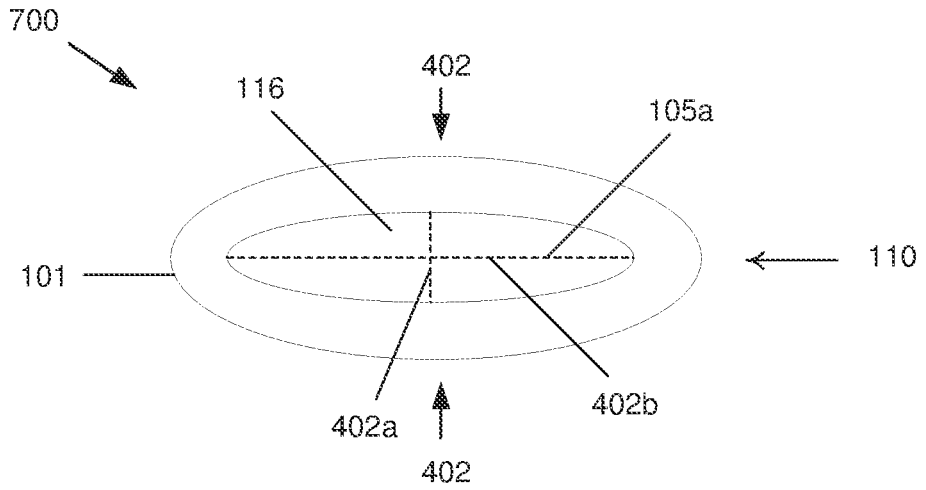
FIG. 7 illustrates a top view of the interface with a horn-shaped end for reception of a smokable element, when a squeezing force is applied to the horn-shaped end, in accordance with disclosed embodiments.

Now referring to FIG. 7, a top view 700 of the interface 110 with a horn-shaped end 101 for reception of a smokable element (not pictured), where a squeezing force 402 is applied to the horn-shaped end 101 of the interface 110, resulting in a deformation of the first cross-sectional shape (not pictured) of the circular opening 105*a* to a second cross-sectional shape 116 which allows for insertion of the smokable end (not pictured) of the smokable element (not pictured) into the deformed circular opening 105*a* of the horn-shaped end 101 of the interface 110 is illustrated. In FIG. 7, the resulting second cross-sectional shape is defined by a first distance 402*a* between the edges of the second cross-sectional shape at the points where the squeezing force 402 is applied and a second distance 402*b* between the edges of the second cross-sectional shape at the points where the deformation of the first cross-sectional shape is greatest.

Figure 8:
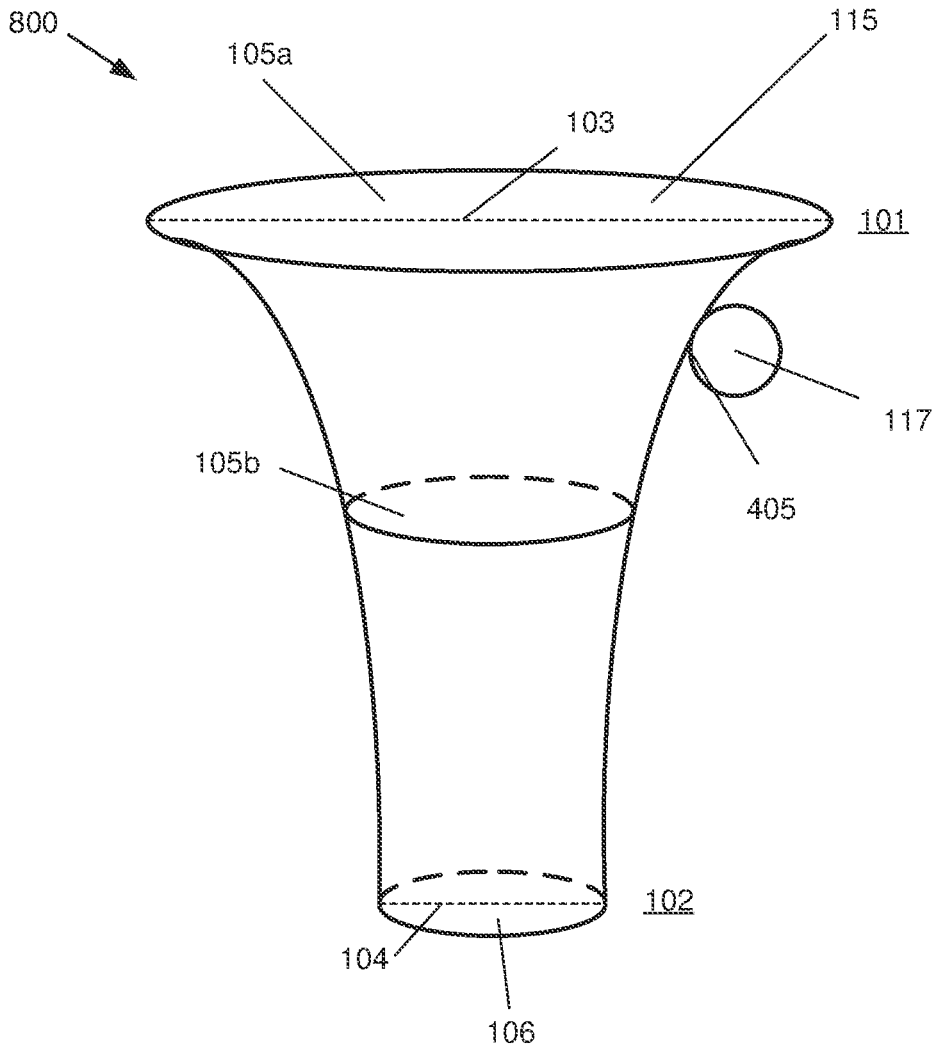
FIG. 8 illustrates a perspective view of the interface with a horn-shaped end for reception of a smokable element, and a rotatably affixed twistable knob where the opening of the horn-shaped end is in its original first shape, in accordance with disclosed embodiments.

Now referring to FIG. 8, a perspective view 800 of the interface 110 with a horn-shaped end 101 for reception of a smokable element (not pictured), and a rotatably affixed 405 twistable knob 117 where the opening 105*a* of the horn-shaped end 101 has a cross-sectional shape 115 is illustrated. In FIG. 8, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, where the horn-shaped end 101 and the round end 102 are opposite each other, where the diameter 103 of the horn-shaped end 101 is larger than the diameter 104 of the round end 102, where the circular opening 105*a* of the horn-shaped end 101 has a first cross-sectional shape 115, and where a twistable knob 117 is rotatably affixed 405 to the interface 110 in a manner that allows the twistable knob 117 to apply a squeezing force (not pictured) to deform the circular opening 105*a* of the horn-shaped end 101 of the interface 110 from its first cross-sectional shape 115 to a second cross-sectional shape 116 which allows for insertion of the smokable end (not pictured) of the smokable element into the deformed circular opening 105*a* of the horn-shaped end 101 of the interface 110. It is noted that the smokable element 210, to be received by interface 110 at the horn-shaped end 101, may actually be received farther into the horn-shaped end 101 than the circular opening 105*a*. For example, if the smokable end 201 of the smokable element 210 is smaller than circular opening 105*a*, then the smokable element 210 will be insertable to a point inside the horn-shaped end 101, e.g., to circular opening 105*b* as an alternative since the horn-shaped end narrows as the smokable element 210 is inserted to eventually match or substantially match structural geometries to form or substantially form a seal there between, as described in a variety of further embodiments below. To further illustrate the point, and for the avoidance of doubt, the smokable element 210 could be received to a point between circular opening 105*a* and circular opening 105*b* as well, wherever the smokable element 210 abuts the inside of the interface 110 via the horn-shaped end 101, e.g., forms a seal, or substantial seal, with the inside of the horn-shaped end 101. It is noted that this twistable knob 117 can be rotatably affixed 405 anywhere on the interface 110 which allows the twistable knob 117 to deform the circular opening 105*a* of the horn-shaped end 101 of the interface 110.

Figure 9:
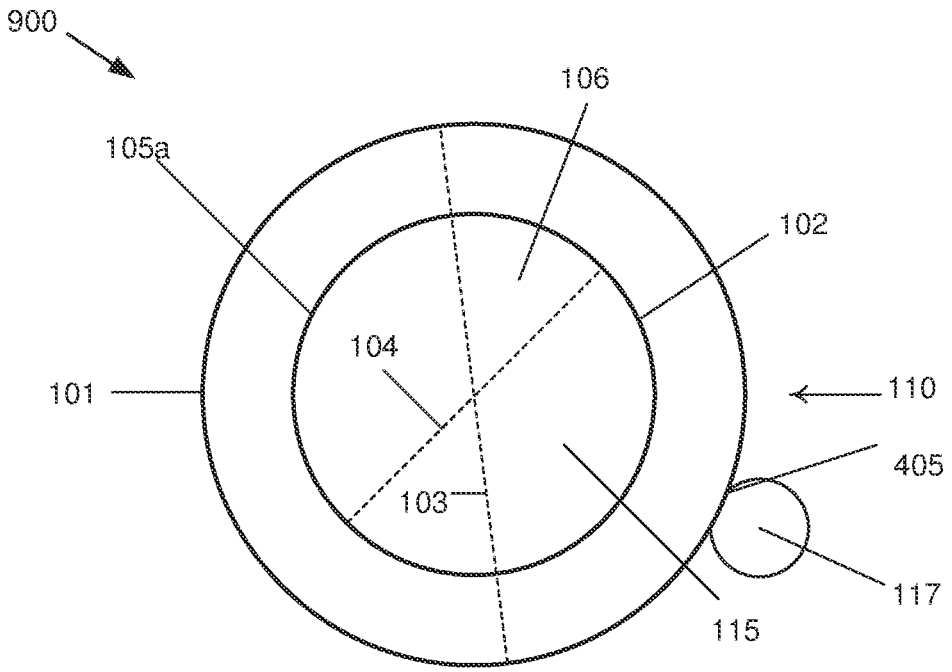
FIG. 9 illustrates a top view of the interface with a horn-shaped end for reception of a smokable element, and a rotatably affixed twistable knob where the opening of the horn-shaped end is in its original first shape, in accordance with disclosed embodiments.

Now referring to FIG. 9, a top view 900 of the interface 110 with a horn-shaped end 101 for reception of a smokable element (not pictured), and a rotatably affixed 405 twistable knob 117 where the circular opening 105 of the horn-shaped end 101 is in its original first shape 115 is illustrated. In FIG. 9, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, where the horn-shaped end 101 and the round end 102 are opposite each other, where the diameter 103 of the horn-shaped end 101 is larger than the diameter 104 of the round end 102, where the circular opening 105*a* of the horn-shaped end 101 has a first cross-sectional shape 115, and where a twistable knob 117 is rotatably affixed 405 to the interface 110 in a manner that allows the twistable knob 117 to apply a squeezing force (not pictured) to deform the circular opening 105*a* of the horn-shaped end 101 of the interface 110 from its first cross-sectional shape 115 to a second cross-sectional shape 116 which allows for insertion of the smokable end (not pictured) of the smokable element into the deformed circular opening 105*a* of the horn-shaped end 101 of the interface 110. In FIG. 9, and as mentioned, this cross-sectional shape 115 can be circular, as shown, but it can also be any other shape suited to the carriage of air, such as star-shaped, rectangular, square, polygonal, U-shaped, etc. It is noted that this twistable knob 117 can be rotatably affixed 405 anywhere on the interface 110 which allows the twistable knob 117 to deform the circular opening 105*a* of the horn-shaped end 101 of the interface 110.

Figure 10:
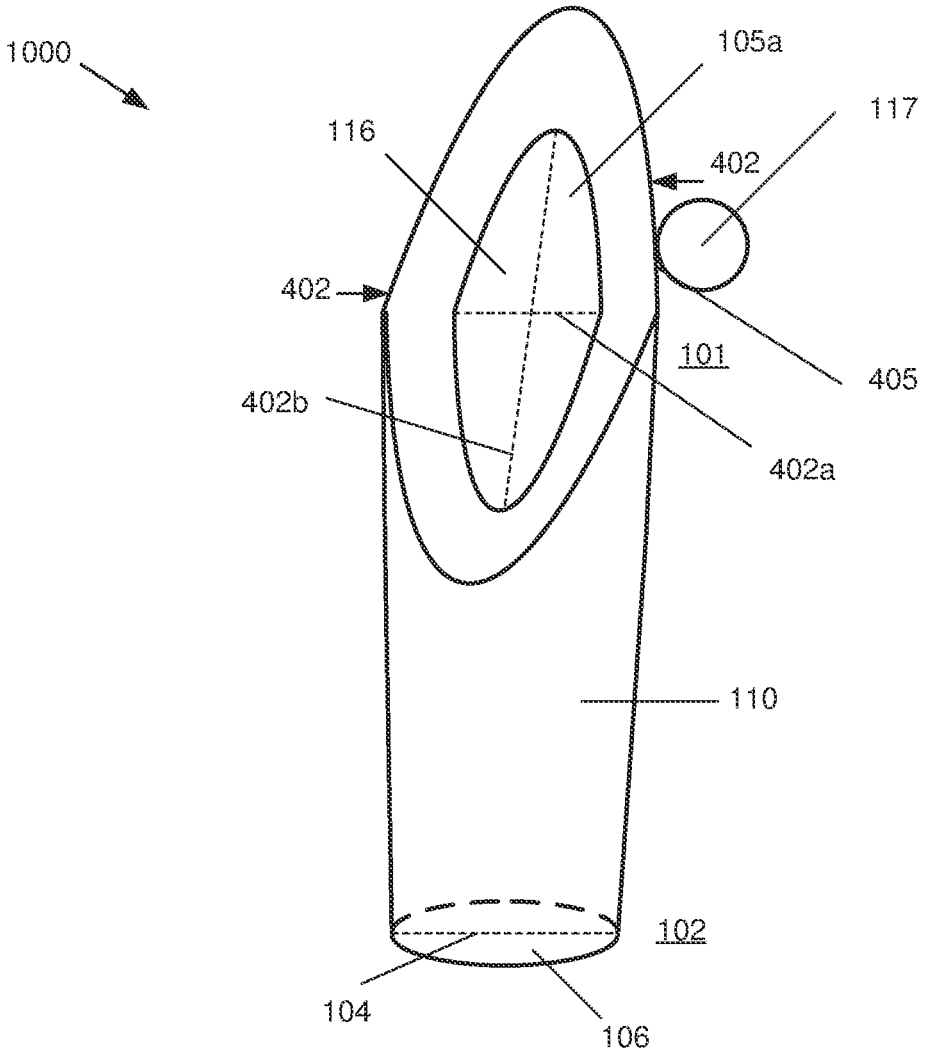
FIG. 10 illustrates a perspective view of the interface with a horn-shaped end for reception of a smokable element, and a rotatably affixed twistable knob where the opening of the horn-shaped end is in its deformed second shape, in accordance with disclosed embodiments.

Now referring to FIG. 10, a perspective view 1000 of the interface 110 with a horn-shaped end 101 for reception of a smokable element (not pictured), and a rotatably affixed 405 twistable knob 117 where the circular opening 105*a* of the horn-shaped end 101 is in its deformed second cross-sectional shape 116 is illustrated. The interface 110 comprises a horn-shaped end 101 with a circular opening 105*a* and a round end 102 with a circular opening 106, where the horn-shaped end 101 and the round end 102 are opposite each other, where the diameter 103 of the horn-shaped end 101 is larger than the diameter 104 of the round end 102, where the circular opening 105*a* of the horn-shaped end 101 has a first cross-sectional shape 115, and where a twistable knob 117 is rotatably affixed 405 to the interface 110 in a manner that allows the twistable knob 117 to apply a squeezing force 402 to deform the circular opening 105*a* of the horn-shaped end 101 of the interface 110 from its first cross-sectional shape 115 to a second cross-sectional shape 116 which allows for insertion of the smokable end (not pictured) of the smokable element into the deformed circular opening 105*a* of the horn-shaped end 101 of the interface 110. In FIG. 10, the resulting second cross-sectional shape is defined by a first distance 402*a* between the edges of the second cross-sectional shape at the points where the squeezing force 402 is applied and a second distance 402*b* between the edges of the second cross-sectional shape at the points perpendicular to the squeezing force 402.

Figure 11:
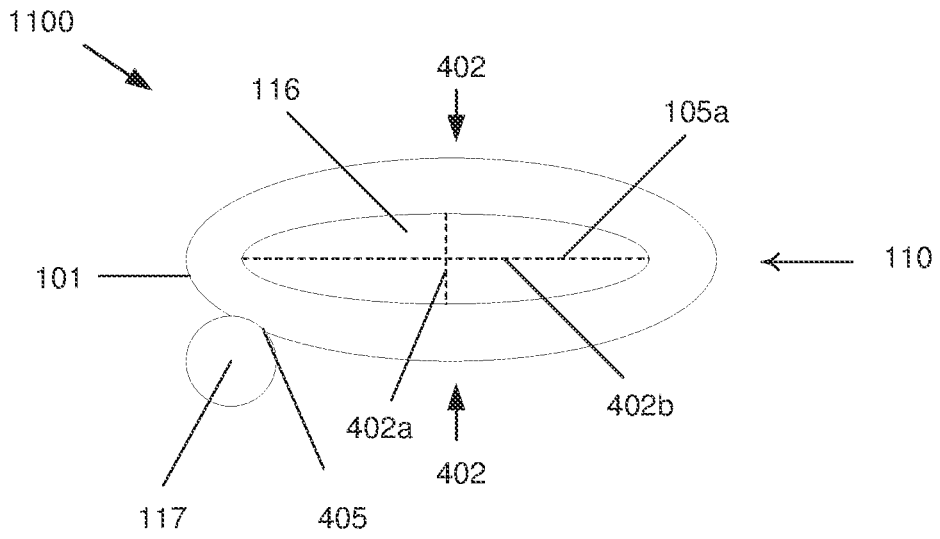
FIG. 11 illustrates a top view of the interface with a horn-shaped end for reception of a smokable element, and a rotatably affixed twistable knob where the opening of the horn-shaped end is in its deformed second shape, in accordance with disclosed embodiments.

Now referring to FIG. 11, a top view 1100 of the interface 110 with a horn-shaped end 101 for reception of a smokable element 210, and a rotatably affixed 405 twistable knob 117 where the circular opening 105 of the horn-shaped end 101 is in its deformed second shape 116 is illustrated. The interface 110 comprises a horn-shaped end 101 with a circular opening 105*a* and a round end 102 with a circular opening 106, where the horn-shaped end 101 and the round end 102 are opposite each other, where the diameter 103 of the horn-shaped end 101 is larger than the diameter 104 of the round end 102, where the circular opening 105*a* of the horn-shaped end 101 has a first cross-sectional shape 115, and where a twistable knob 117 is rotatably affixed 405 to the interface 110 in a manner that allows the twistable knob 117 to apply a squeezing force 402 to deform the circular opening 105*a* of the horn-shaped end 101 of the interface 110 from its first cross-sectional shape 115 to a second cross-sectional shape 116 which allows for insertion of the smokable end (not pictured) of the smokable element into the deformed circular opening 105*a* of the horn-shaped end 101 of the interface 110. In FIG. 11, the resulting second cross-sectional shape is defined by a first distance 402*a* between the edges of the second cross-sectional shape at the points where the squeezing force 402 is applied and a second distance 402*b* between the edges of the second cross-sectional shape at the points perpendicular to the squeezing force 402.

Figure 12:
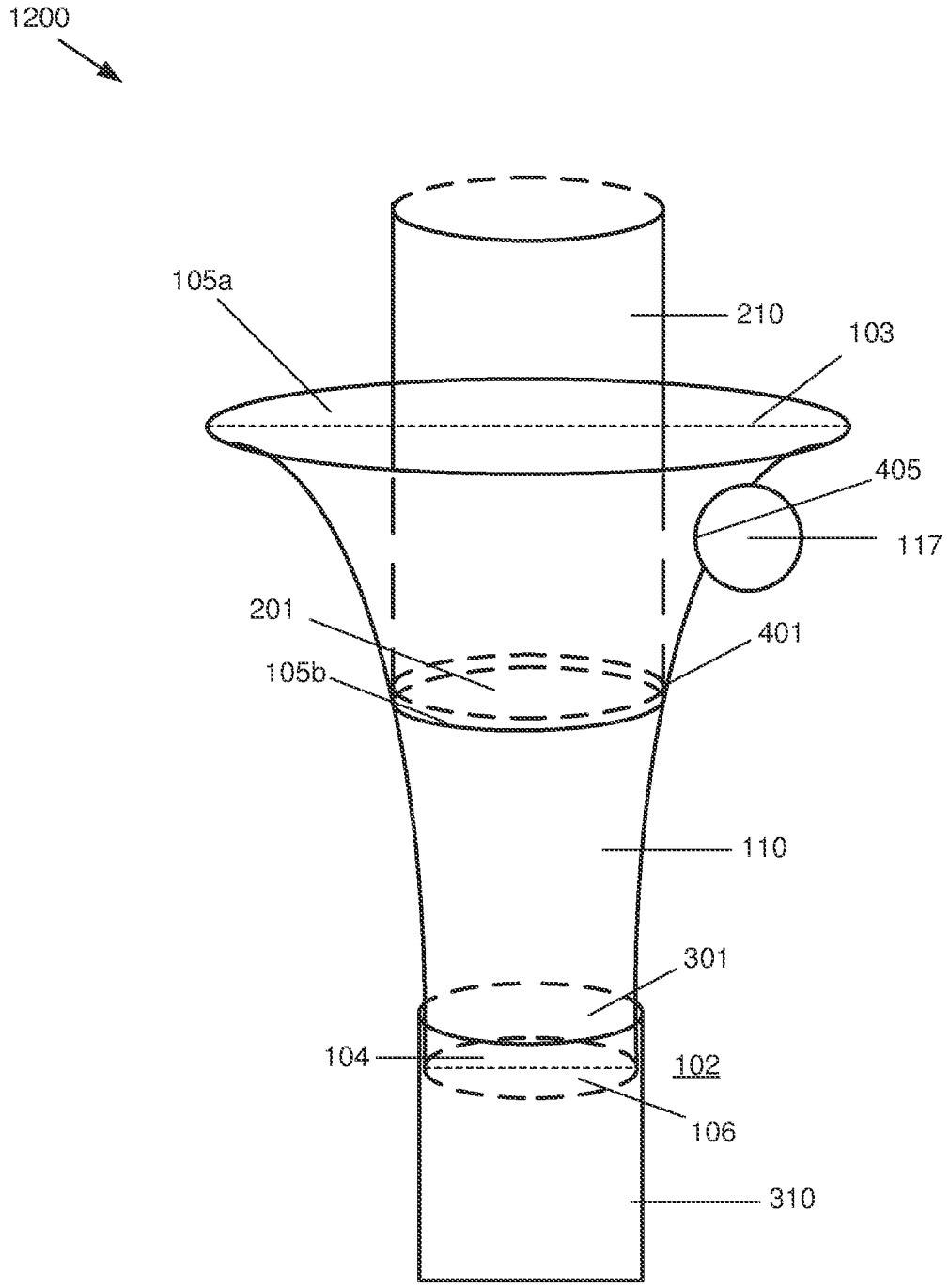
FIG. 12 illustrates a perspective view of the interface with a horn-shaped end for reception of a smokable element, and a rotatably affixed knob when affixed to an air filter and a smokable element is inserted, in accordance with disclosed embodiments.

Now referring to FIG. 12, a perspective view 1200 of the interface 110 with a horn-shaped end 101 for reception of a smokable element 210, and a rotatably affixed 405 twistable knob 117 where the round end 102 of the interface 110 is affixed 404 to a circular opening 301 of an air filter 310, and where the smokable element 210 is inserted 401 into the circular opening 105 of the horn-shaped end 101 of the interface 110 is illustrated. It is noted that the smokable element 210, to be received by interface 110 at the horn-shaped end 101, may actually be received farther into the horn-shaped end 101 than the circular opening 105*a*. For example, if the smokable end 201 of the smokable element 210 is smaller than circular opening 105*a*, then the smokable element 210 will be insertable to a point inside the horn-shaped end 101, e.g., to circular opening 105*b* as an alternative since the horn-shaped end narrows as the smokable element 210 is inserted to eventually match or substantially match structural geometries to form or substantially form a seal there between, as described in a variety of further embodiments below. To further illustrate the point, and for the avoidance of doubt, the smokable element 210 could be received to a point between circular opening 105*a* and circular opening 105*b* as well, wherever the smokable element 210 abuts the inside of the interface 110 via the horn-shaped end 101, e.g., forms a seal, or substantial seal, with the inside of the horn-shaped end 101.

Figure 13:
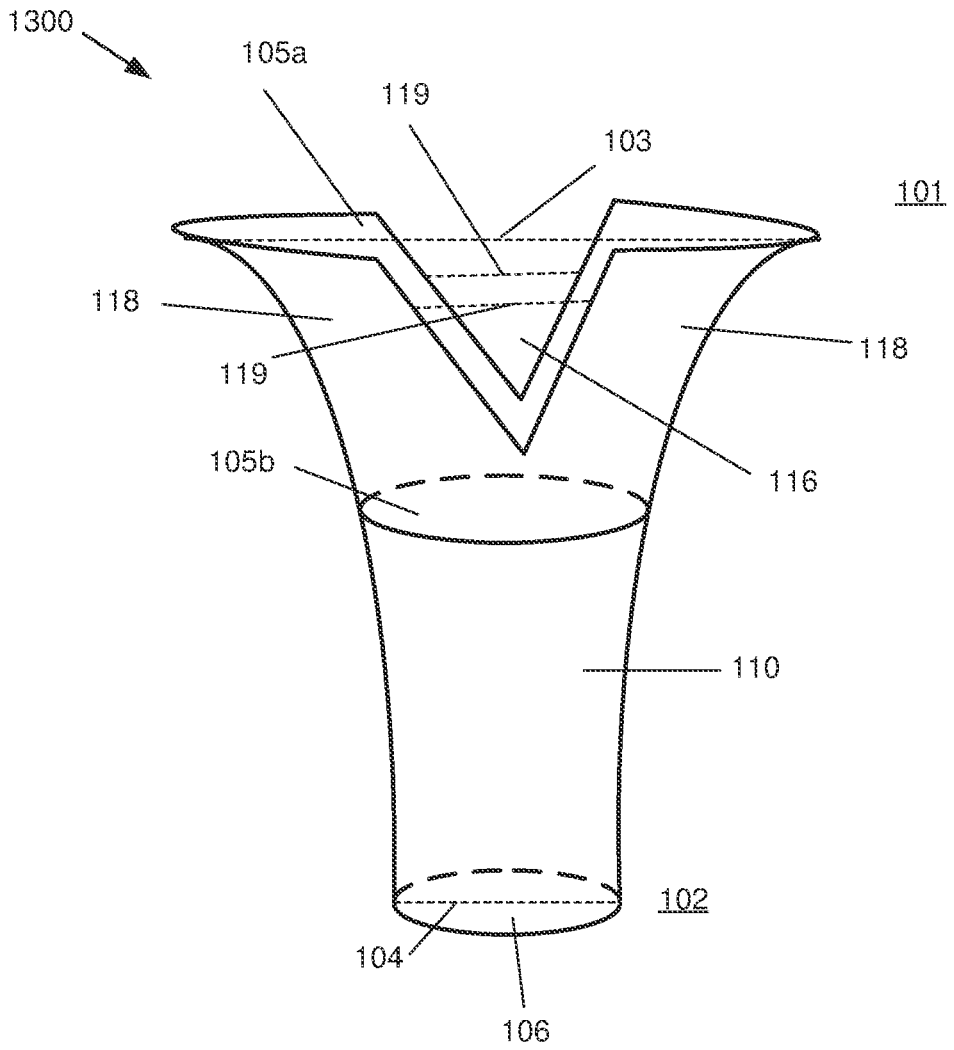
FIG. 13 illustrates a perspective view of the interface with a horn-shaped end for reception of a smokable element, where the horn-shaped end comprises at least two hinged-flaps, and where the at least two hinged-flaps are open, in accordance with disclosed embodiments.

Now referring to FIG. 13, a perspective view 1300 of the interface 110 with a horn-shaped end 101 for reception of a smokable element (not pictured), where the horn-shaped end 101 comprises at least two hinged-flaps 118, and where the at least two hinged-flaps 118 are open 119 is illustrated. In FIG. 13, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, and where the horn-shaped end 101 of the interface 110 comprises at least two hinged-flaps 118 which can be opened 119 by an application of force 406, resulting in a deformation of the circular opening 105*a* of the horn-shaped end 101 of the interface 110 from a first cross-sectional shape 115 (not pictured) to a second cross-sectional shape 116 which allows for insertion (not pictured) of the smokable end (not pictured) of the smokable element into the deformed circular opening 105*a* of the horn-shaped end 101 of the interface 110. It is noted that the smokable element, to be received by interface 110 at the horn-shaped end 101, may actually be received farther into the horn-shaped end 101 than the circular opening 105*a*. For example, if the smokable end (not pictured) of the smokable element is smaller than circular opening 105*a*, then the smokable element will be insertable to a point inside the horn-shaped end 101, e.g., to circular opening 105*b* as an alternative since the horn-shaped end narrows as the smokable element is inserted to eventually match or substantially match structural geometries to form or substantially form a seal there between, as described in a variety of further embodiments below. To further illustrate the point, and for the avoidance of doubt, the smokable element could be received to a point between circular opening 105*a* and circular opening 105*b* as well, wherever the smokable element abuts the inside of the interface 110 via the horn-shaped end 101, e.g., forms a seal, or substantial seal, with the inside of the horn-shaped end 101.

Figure 14:
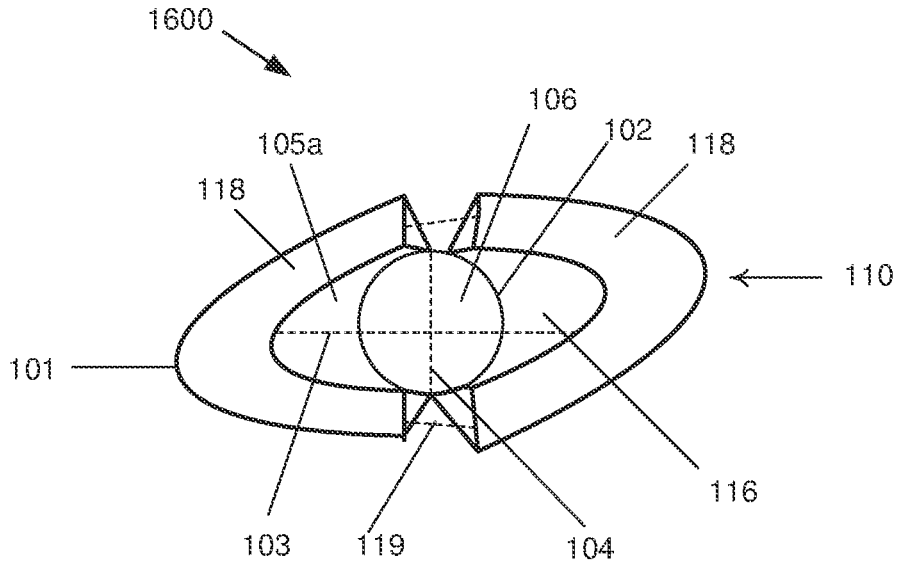
FIG. 14 illustrates a top view of the interface with a horn-shaped end for reception of a smokable element, where the horn-shaped end comprises at least two hinged-flaps, and where the at least two hinged-flaps are open, in accordance with disclosed embodiments.

Now referring to FIG. 14, a top view 1400 of the interface 110 with a horn-shaped end 101 for reception of a smokable element 210 (element 210 not pictured), where the horn-shaped end 101 comprises at least two hinged-flaps 118, and where the at least two hinged-flaps 118 are open 119 is illustrated. In FIG. 14, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, and where the horn-shaped end 101 of the interface 110 comprises at least two hinged-flaps 118 which can be opened 119 by an application of force 406, resulting in a deformation of the circular opening 105*a* of the horn-shaped end 101 of the interface 110 from a first cross-sectional shape 115 (not pictured) to a second cross-sectional shape 116 which allows for insertion (not pictured) of the smokable end (not pictured) of the smokable element into the deformed circular opening 105*a* of the horn-shaped end 101 of the interface 110.

Figure 15:
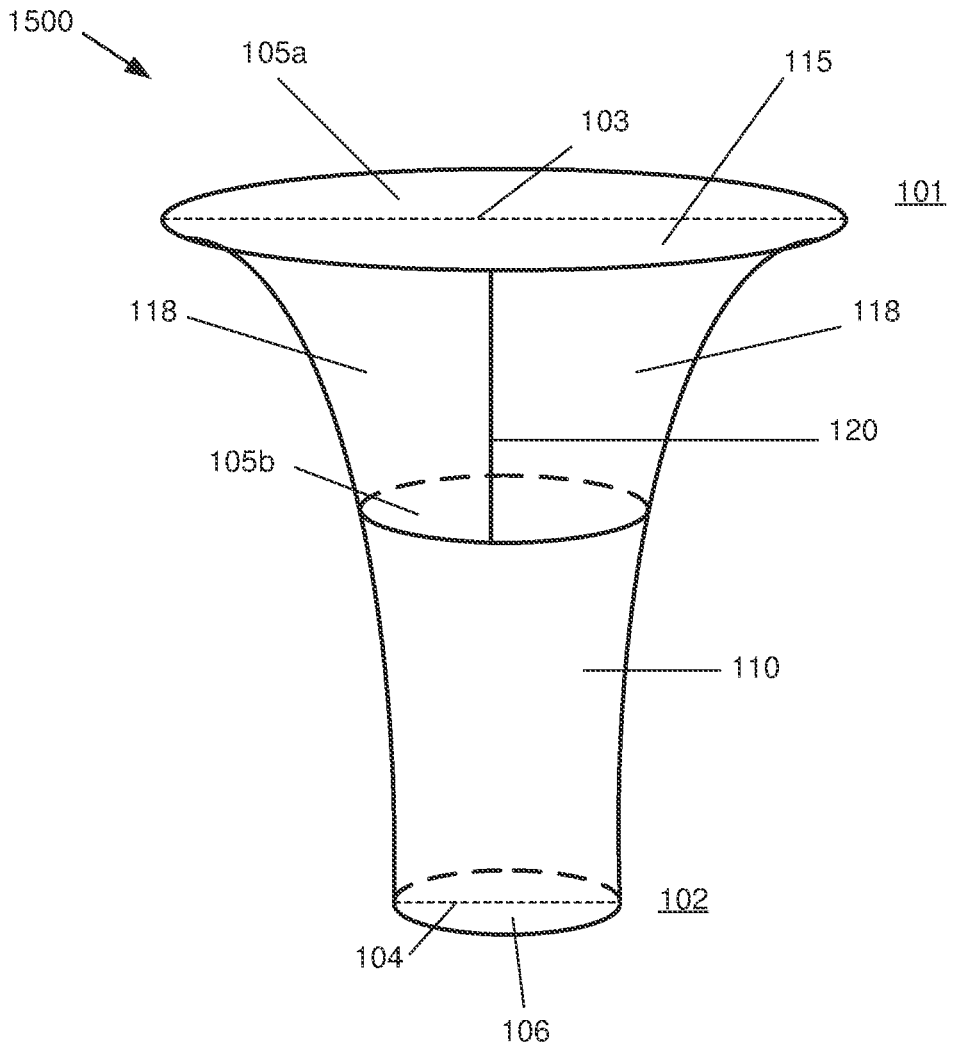
FIG. 15 illustrates a perspective view of the interface with a horn-shaped end for reception of a smokable element, where the horn-shaped end comprises at least two hinged-flaps, and where the at least two hinged-flaps are closed, in accordance with disclosed embodiments.

Now referring to FIG. 15, a perspective view 1500 of the interface 110 with a horn-shaped end 101 for reception of a smokable element (not pictured), where the horn-shaped end 101 comprises at least two hinged-flaps 118, and where the at least two hinged-flaps 118 are closed 120 is illustrated. In FIG. 15, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, and where the horn-shaped end 101 of the interface 110 comprises at least two hinged-flaps 118 which can be closed 120 by an application of force 407, resulting in a reformation of the circular opening 105*a* of the horn-shaped end 101 of the interface 110 from its deformed second cross-sectional shape 116 (not pictured) to its first cross-sectional shape 115 which creates an air seal (not pictured) between an outside of the smokable end (not pictured) and the horn-shaped end 101 of the interface 110. It is noted that the smokable element, to be received by interface 110 at the horn-shaped end 101, may actually be received farther into the horn-shaped end 101 than the circular opening 105*a*. For example, if the smokable end of the smokable element is smaller than circular opening 105*a*, then the smokable element will be insertable to a point inside the horn-shaped end 101, e.g., to circular opening 105*b* as an alternative since the horn-shaped end narrows as the smokable element is inserted to eventually match or substantially match structural geometries to form or substantially form a seal there between, as described in a variety of further embodiments below. To further illustrate the point, and for the avoidance of doubt, the smokable element could be received to a point between circular opening 105*a* and circular opening 105*b* as well, wherever the smokable element abuts the inside of the interface 110 via the horn-shaped end 101, e.g., forms a seal, or substantial seal, with the inside of the horn-shaped end 101.

Figure 16:
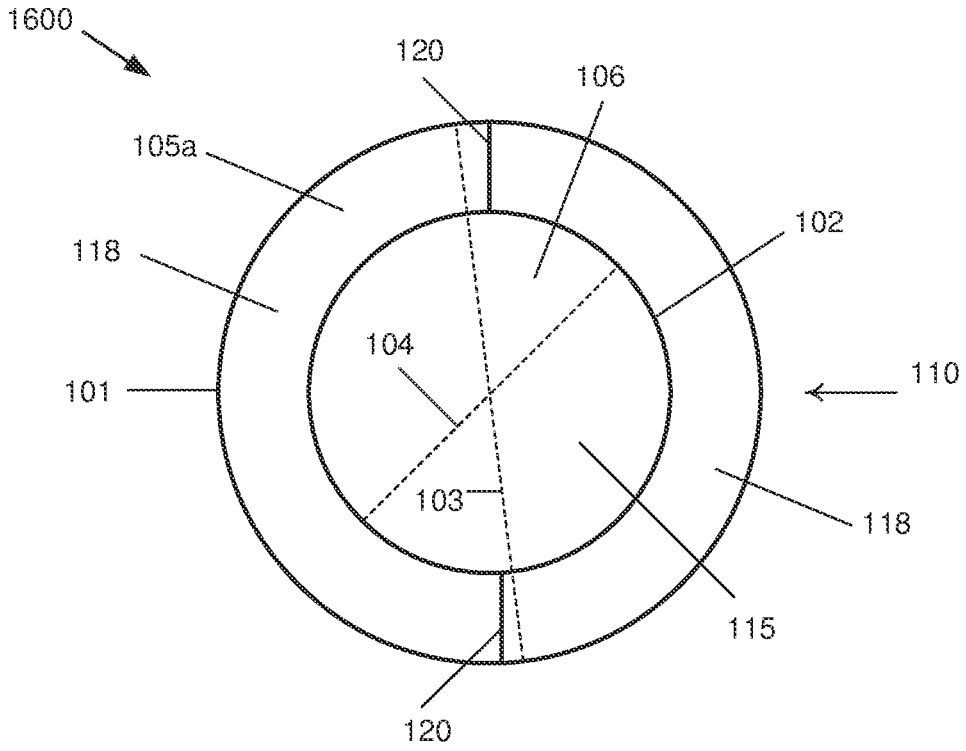
FIG. 16 illustrates a top view of the interface with a horn-shaped end for reception of a smokable element, where the horn-shaped end comprises at least two hinged-flaps, and where the at least two hinged-flaps are closed, in accordance with disclosed embodiments.

Now referring to FIG. 16, a top view 1600 of the interface 110 with a horn-shaped end 101 for reception of a smokable element (not pictured), where the horn-shaped end 101 comprises at least two hinged-flaps 118, and where the at least two hinged-flaps 118 are closed 120 is illustrated. In FIG. 16, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106 (elements 102 and 106 not pictured), and where the horn-shaped end 101 of the interface 110 comprises at least two hinged-flaps 118 which can be closed 120 by an application of force 407, resulting in a reformation of the circular opening 105*a* of the horn-shaped end 101 of the interface 110 from its deformed second cross-sectional shape (not pictured) to its first cross-sectional shape 115 which creates an air seal 114 (not pictured) between an outside of the smokable end (not pictured) and the horn-shaped end 101 of the interface 110. In FIG. 16, and as mentioned, this cross-sectional shape 115 can be circular, as shown, but it can also be any other shape suited to the carriage of air, such as star-shaped, rectangular, square, polygonal, U-shaped, etc.

Figure 17:
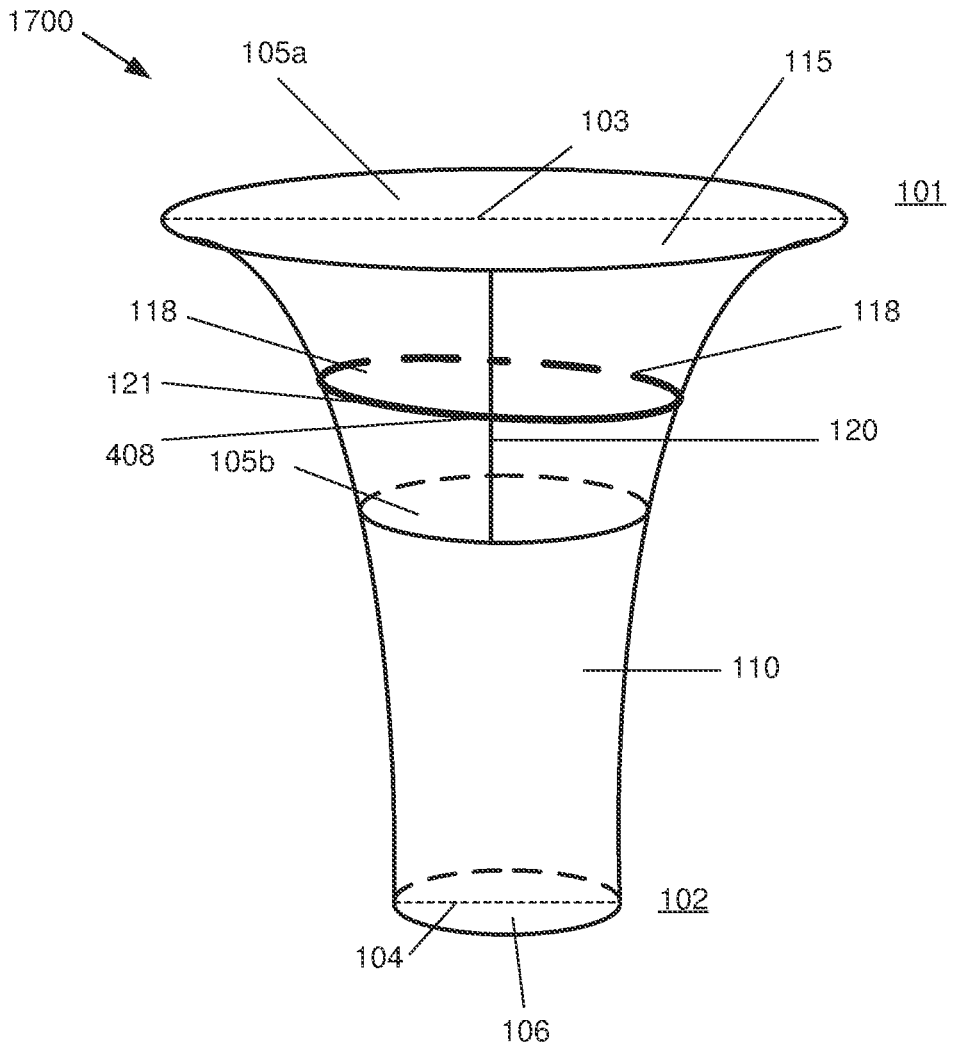
FIG. 17 illustrates a perspective view of the interface with a horn-shaped end for reception of a smokable element, where the horn-shaped end comprises at least two hinged-flaps, where the at least two hinged-flaps are closed, and where a slidably movable ring holds the at least two hinged-flaps closed, in accordance with disclosed embodiments.

Now referring to FIG. 17, a perspective view 1700 of the interface 110 with a horn-shaped end 101 for reception of a smokable element (not pictured), where the horn-shaped end 101 comprises at least two hinged-flaps 118, where the at least two hinged-flaps 118 are closed 120, and where a slidably movable ring 121 holds 408 the at least two hinged-flaps 118 closed 120 is illustrated. In FIG. 17, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, where the horn-shaped end 101 of the interface 110 comprises at least two hinged-flaps 118 which can be closed 120 by an application of force 407, resulting in a reformation of the circular opening 105*a* of the horn-shaped end 101 of the interface 110 from its deformed second cross-sectional shape (not pictured) to its first cross-sectional shape 115 which creates an air seal (not pictured) between an outside of the smokable end (not pictured) and the horn-shaped end 101 of the interface 110, where the slidably movable ring 121 snuggly fits around the exterior of the horn-shaped end 101 of the interface 110 preventing the at least two hinged flaps 118 from opening 119, and where the slidably movable ring 121 can be moved along the length of the interface 110 toward the horn-shaped end 101 away from the round end 102 via an application of force (not pictured) resulting in allowing the at least two hinged-flaps 118 to be remain closed 120. It is noted that the smokable element, to be received by interface 110 at the horn-shaped end 101, may actually be received farther into the horn-shaped end 101 than the circular opening 105*a*. For example, if the smokable end of the smokable element is smaller than circular opening 105*a*, then the smokable element will be insertable to a point inside the horn-shaped end 101, e.g., to circular opening 105*b* as an alternative since the horn-shaped end narrows as the smokable element is inserted to eventually match or substantially match structural geometries to form or substantially form a seal there between, as described in a variety of further embodiments below. To further illustrate the point, and for the avoidance of doubt, the smokable element could be received to a point between circular opening 105*a* and circular opening 105*b* as well, wherever the smokable element abuts the inside of the interface 110 via the horn-shaped end 101, e.g., forms a seal, or substantial seal, with the inside of the horn-shaped end 101.

Figure 18:
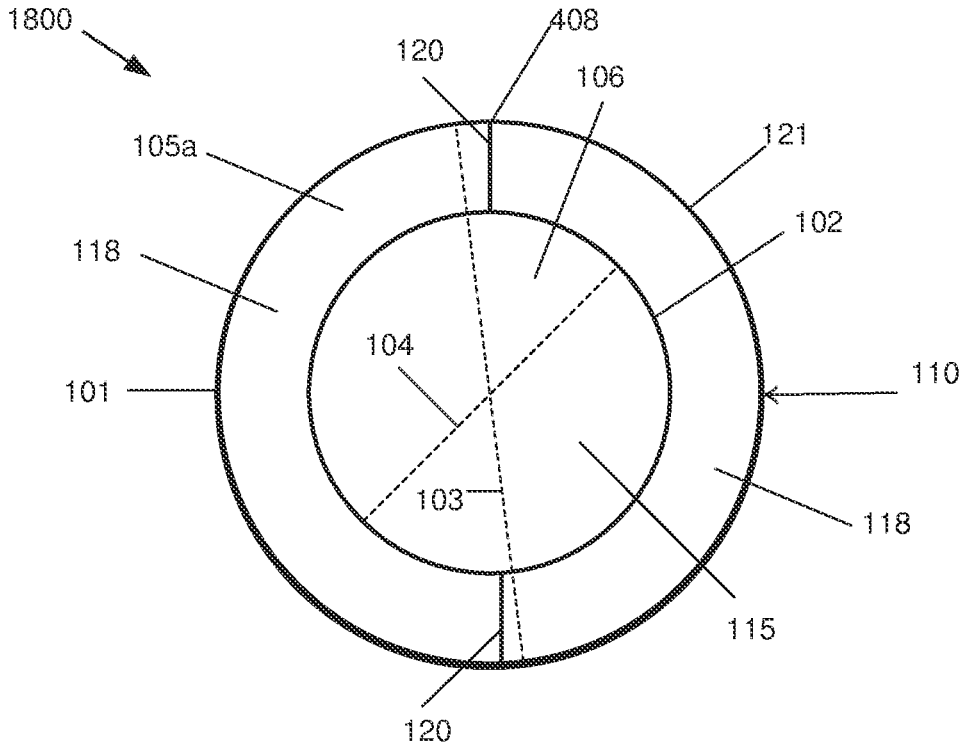
FIG. 18 illustrates a top view of the interface with a horn-shaped end for reception of a smokable element, where the horn-shaped end comprises at least two hinged-flaps, where the at least two hinged-flaps are closed, and where a slidably movable ring holds the at least two hinged-flaps closed, in accordance with disclosed embodiments.

Now referring to FIG. 18, a top view 1800 of the interface 110 with a horn-shaped end 101 for reception of a smokable element (not pictured), where the horn-shaped end 101 comprises at least two hinged-flaps 118, where the at least two hinged-flaps 118 are closed 120, and where a slidably movable ring 121 holds 408 the at least two hinged-flaps 118 closed 120 is illustrated. In FIG. 18, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, where the horn-shaped end 101 of the interface 110 comprises at least two hinged-flaps 118 which can be closed 120 by an application of force 407, resulting in a reformation of the circular opening 105*a* of the horn-shaped end 101 of the interface 110 from its deformed second cross-sectional shape (not pictured) to its first cross-sectional shape 115 which creates an air seal (not pictured) between an outside of the smokable end (not pictured) and the horn-shaped end 101 of the interface 110, where the slidably movable ring 121 snuggly fits around the exterior of the horn-shaped end 101 of the interface 110 preventing the at least two hinged flaps 118 from opening 119, and where the slidably movable ring 121 can be moved along the length of the interface 110 toward the horn-shaped end 101 away from the round end 102 via an application of force (not pictured) resulting in allowing the at least two hinged-flaps 118 to be remain closed 120. In FIG. 18, and as mentioned, this cross-sectional shape 115 can be circular, as shown, but it can also be any other shape suited to the carriage of air, such as star-shaped, rectangular, square, polygonal, U-shaped, etc.

Figure 19:
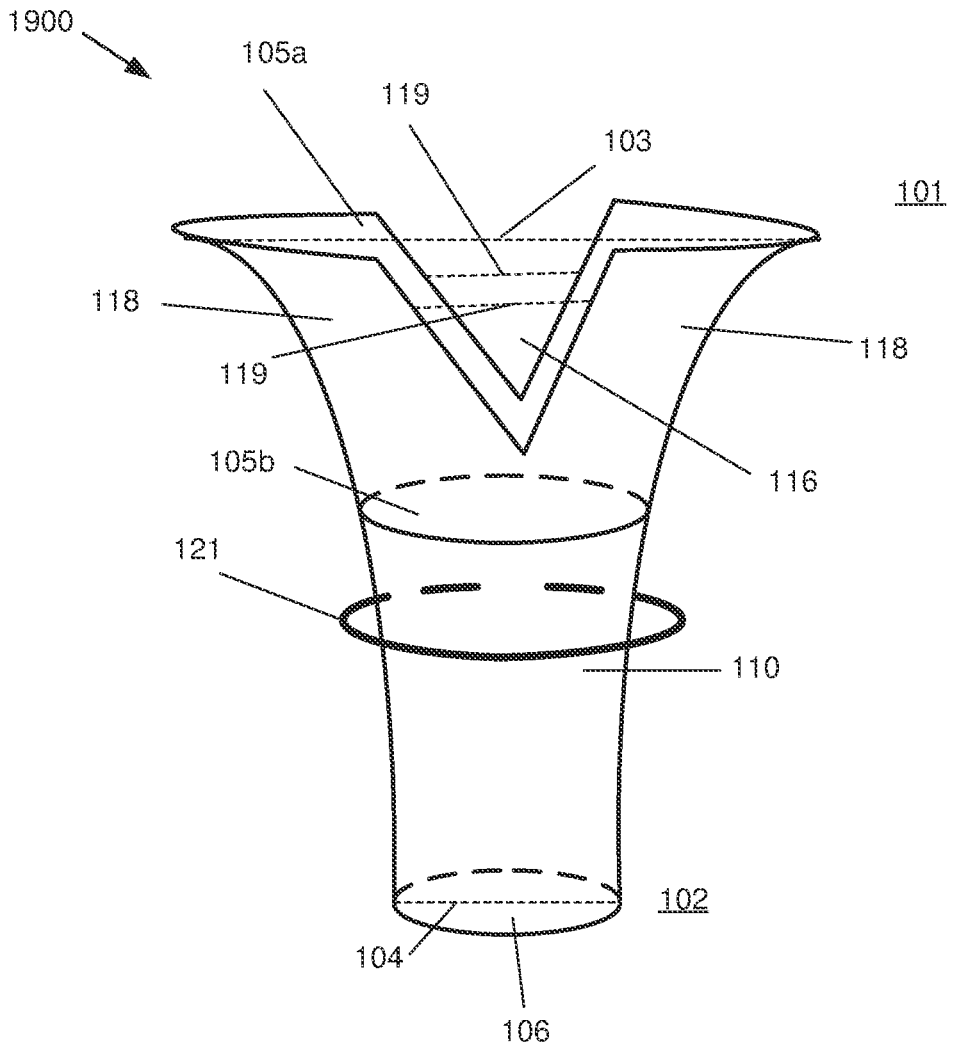
FIG. 19 illustrates a perspective view of the interface with a horn-shaped end for reception of a smokable element, where the horn-shaped end comprises at least two hinged-flaps, where the at least two hinged-flaps are open, and where a slidably ring holds the at least two hinged-flaps closed, in accordance with disclosed embodiments.

Now referring to FIG. 19, perspective view 1900 of the interface 110 with a horn-shaped end 101 for reception of a smokable element (not pictured), where the horn-shaped end 101 comprises at least two hinged-flaps 118, where the at least two hinged-flaps 118 are open 119, and where a slidably movable ring 121 holds 408 the at least two hinged-flaps 118 closed (not pictured) is illustrated. In FIG. 19, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, where the horn-shaped end 101 of the interface 110 comprises at least two hinged-flaps 118 which can be closed 120 by an application of force 407, resulting in a reformation of the circular opening 105*a* of the horn-shaped end 101 of the interface 110 from its deformed second cross-sectional shape 116 to its first cross-sectional shape (not pictured) which creates an air seal (not pictured) between an outside of the smokable end (not pictured) and the horn-shaped end 101 of the interface 110, where the slidably movable ring 121 snuggly fits around the exterior of the horn-shaped end 101 of the interface 110 preventing the at least two hinged flaps 118 from opening 119, and where the slidably movable ring 121 can be moved along the length of the interface 110 toward the horn-shaped end 101 away from the round end 102 via an application of force (not pictured) resulting in allowing the at least two hinged-flaps 118 to be remain closed 120. It is noted that the smokable element, to be received by interface 110 at the horn-shaped end 101, may actually be received farther into the horn-shaped end 101 than the circular opening 105*a*. For example, if the smokable end of the smokable element is smaller than circular opening 105*a*, then the smokable element will be insertable to a point inside the horn-shaped end 101, e.g., to circular opening 105*b* as an alternative since the horn-shaped end narrows as the smokable element is inserted to eventually match or substantially match structural geometries to form or substantially form a seal there between, as described in a variety of further embodiments below. To further illustrate the point, and for the avoidance of doubt, the smokable element could be received to a point between circular opening 105*a* and circular opening 105*b* as well, wherever the smokable element abuts the inside of the interface 110 via the horn-shaped end 101, e.g., forms a seal, or substantial seal, with the inside of the horn-shaped end 101.

Figure 20:
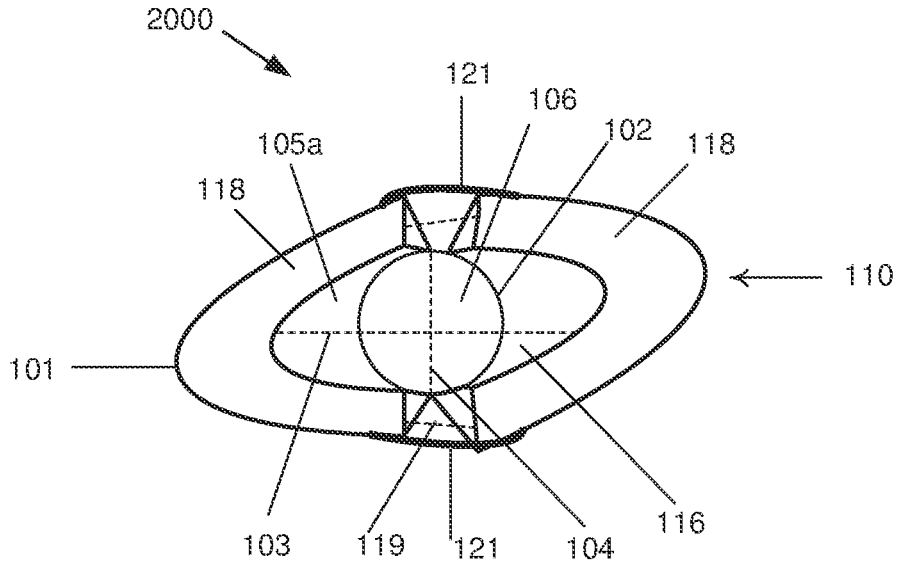
FIG. 20 illustrates a top view of the interface with a horn-shaped end for reception of a smokable element, where the horn-shaped end comprises at least two hinged-flaps, where the at least two hinged-flaps are open, and where a slidably movable ring holds the at least two hinged-flaps closed, in accordance with disclosed embodiments.

Now referring to FIG. 20, a top view 2000 of the interface 110 with a horn-shaped end 101 for reception of a smokable element (not pictured), where the horn-shaped end 101 comprises at least two hinged-flaps 118, where the at least two hinged-flaps 118 are open 119, and where a slidably movable ring 121 holds 408 the at least two hinged-flaps 118 closed (not pictured) is illustrated. In FIG. 20, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, where the horn-shaped end 101 of the interface 110 comprises at least two hinged-flaps 118 which can be closed 120 by an application of force 407, resulting in a reformation of the circular opening 105*a* of the horn-shaped end 101 of the interface 110 from its deformed second cross-sectional shape 116 to its first cross-sectional shape (not pictured) which creates an air seal (not pictured) between an outside of the smokable end (not pictured) and the horn-shaped end 101 of the interface 110, where the slidably movable ring 121 snuggly fits around the exterior of the horn-shaped end 101 of the interface 110 preventing the at least two hinged flaps 118 from opening 119, and where the slidably movable ring 121 can be moved along the length of the interface 110 toward the horn-shaped end 101 away from the round end 102 via an application of force (not pictured) resulting in allowing the at least two hinged-flaps 118 to be remain closed 120.

Figure 21:
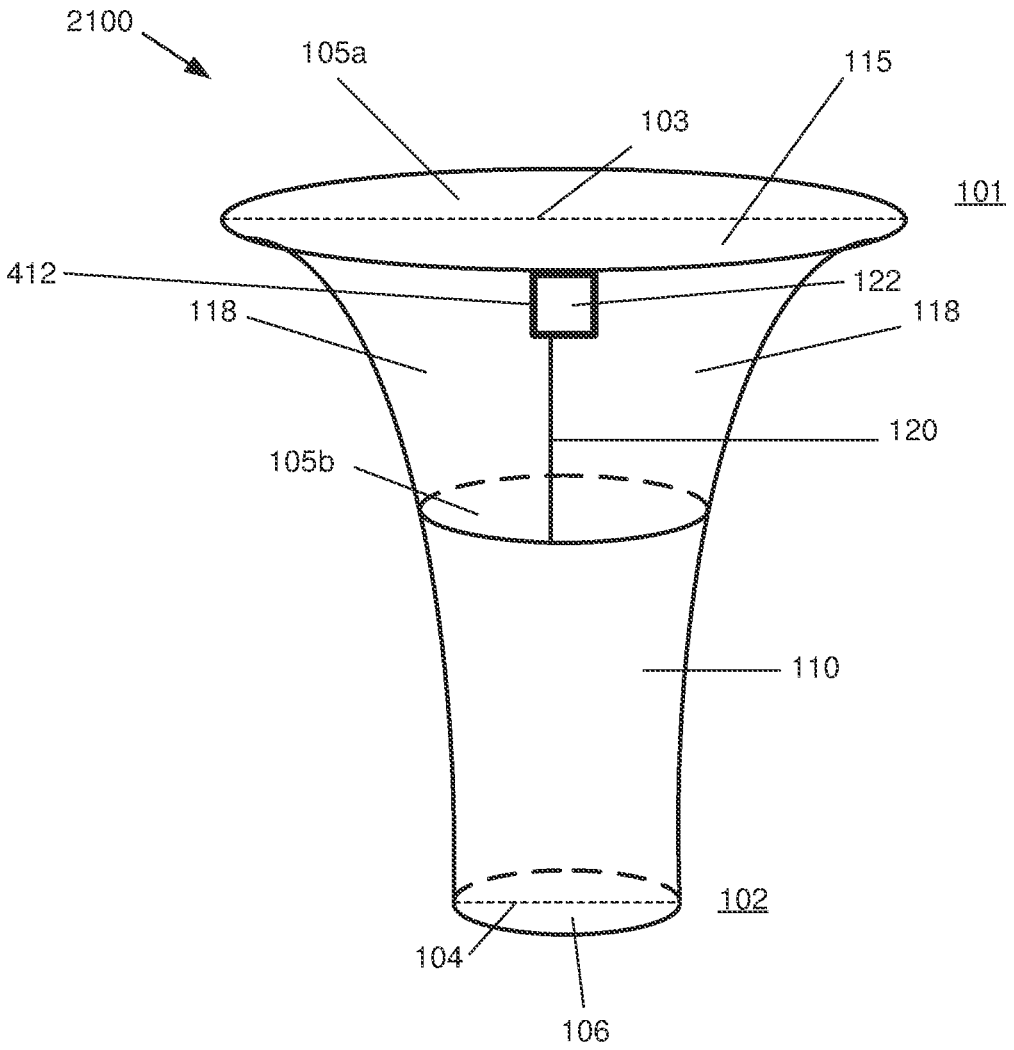
FIG. 21 illustrates a perspective view of the interface with a horn-shaped end for reception of a smokable element, where the horn-shaped end comprises at least two hinged-flaps, where the at least two hinged-flaps are closed, and where at least one clip holds the at least two hinged-flaps closed, in accordance with disclosed embodiments.

Now referring to FIG. 21, a perspective view 2100 of the interface 110 with a horn-shaped end 101 for reception of a smokable element (not pictured), where the horn-shaped end 101 comprises at least two hinged-flaps 118, where the at least two hinged-flaps 118 are closed 120, and where at least one clip 122 holds 409 the at least two hinged-flaps 118 closed 120 is illustrated. In FIG. 21, the circular opening 105*a* is defined by the diameter 103 and the circular opening 106 is defined by the diameter 104, as shown. The interface 110 comprises a horn-shaped end 101 with a circular opening 105 and a round end 102 with a circular opening 106, where the horn-shaped end 101 of the interface 110 comprises at least two hinged-flaps 118 which can be closed 120 by an application of force 407, resulting in a reformation of the circular opening 105*a* of the horn-shaped end 101 of the interface 110 from its deformed second cross-sectional shape (not pictured) to its first cross-sectional shape 115 which creates an air seal (not pictured) between an outside of the smokable end (not pictured) and the horn-shaped end 101 of the interface 110, and where at least one clip 122 can be removably affixed 412 to the at least two hinged-flaps 118 by an application of force 413 which prevents the at least two hinged-flaps 118 from opening 119. It is noted that the smokable element, to be received by interface 110 at the horn-shaped end 101, may actually be received farther into the horn-shaped end 101 than the circular opening 105*a*. For example, if the smokable end of the smokable element is smaller than circular opening 105*a*, then the smokable element will be insertable to a point inside the horn-shaped end 101, e.g., to circular opening 105*b* as an alternative since the horn-shaped end narrows as the smokable element is inserted to eventually match or substantially match structural geometries to form or substantially form a seal there between, as described in a variety of further embodiments below. To further illustrate the point, and for the avoidance of doubt, the smokable element could be received to a point between circular opening 105*a* and circular opening 105*b* as well, wherever the smokable element abuts the inside of the interface 110 via the horn-shaped end 101, e.g., forms a seal, or substantial seal, with the inside of the horn-shaped end 101. It is also noted that the at least one clip can be removably affixed anywhere on the interface 110 which allows the at least one clip 122 to hold 409 the at least two hinged-flaps 118 closed 120.

Figure 22:
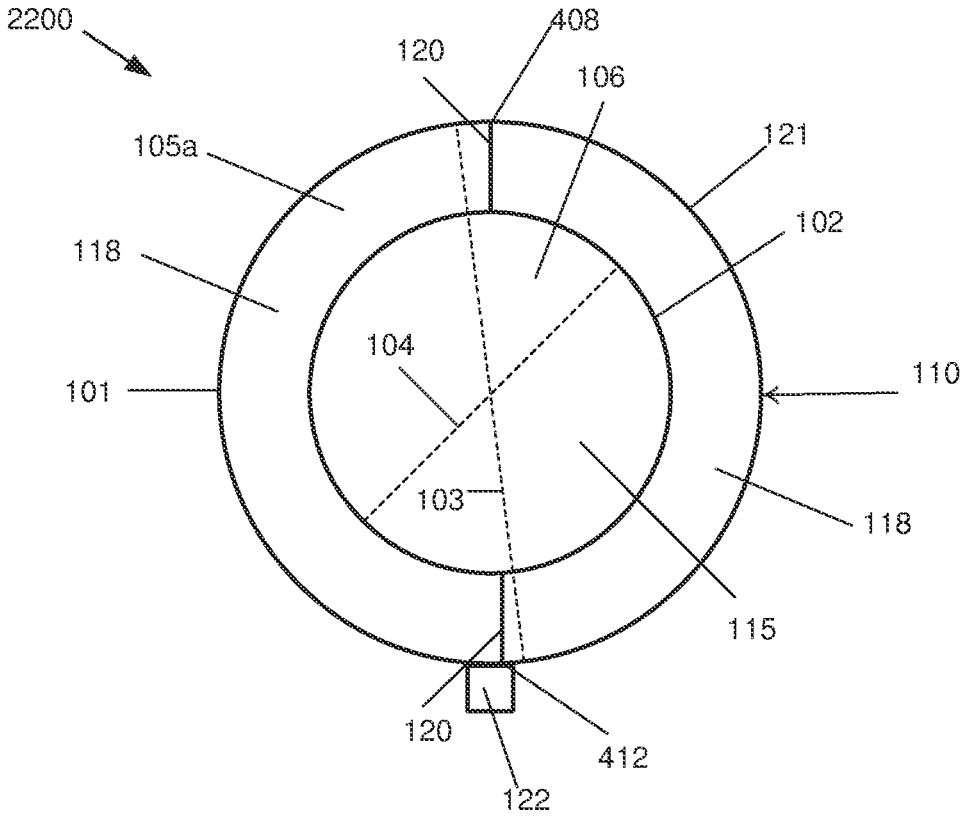
FIG. 22 illustrates a top view of the interface with a horn-shaped end for reception of a smokable element, where the horn-shaped end comprises at least two hinged-flaps, where the at least two hinged-flaps are closed, and where at least one clip holds the at least two hinged-flaps closed, in accordance with disclosed embodiments.

Now referring to FIG. 22, a top view 2200 of the interface 110 with a horn-shaped end 101 for reception of a smokable element (not pictured), where the horn-shaped end 101 comprises at least two hinged-flaps 118, where the at least two hinged-flaps 118 are closed 120, and where at least one clip 122 holds 409 the at least two hinged-flaps 118 closed 120 is illustrated. In FIG. 22, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, and where the horn-shaped end 101 of the interface 110 comprises at least two hinged-flaps 118 which can be closed 120 by an application of force 407, resulting in a reformation of the circular opening 105*a* of the horn-shaped end 101 of the interface 110 from its deformed second cross-sectional shape (not pictured) to its first cross-sectional shape 115 which creates an air seal (not pictured) between an outside of the smokable end (not pictured) and the horn-shaped end 101 of the interface 110, and where at least one clip 122 can be removably affixed 412 to the at least two hinged-flaps 118 by an application of force 413 which prevents the at least two hinged-flaps 118 from opening 119. In FIG. 22, and as mentioned, this cross-sectional shape 115 can be circular, as shown, but it can also be any other shape suited to the carriage of air, such as star-shaped, rectangular, square, polygonal, U-shaped, etc. It is noted that the at least one clip can be removably affixed anywhere on the interface 110 which allows the at least one clip 122 to hold 409 the at least two hinged-flaps 118 closed 120.

Figure 23:
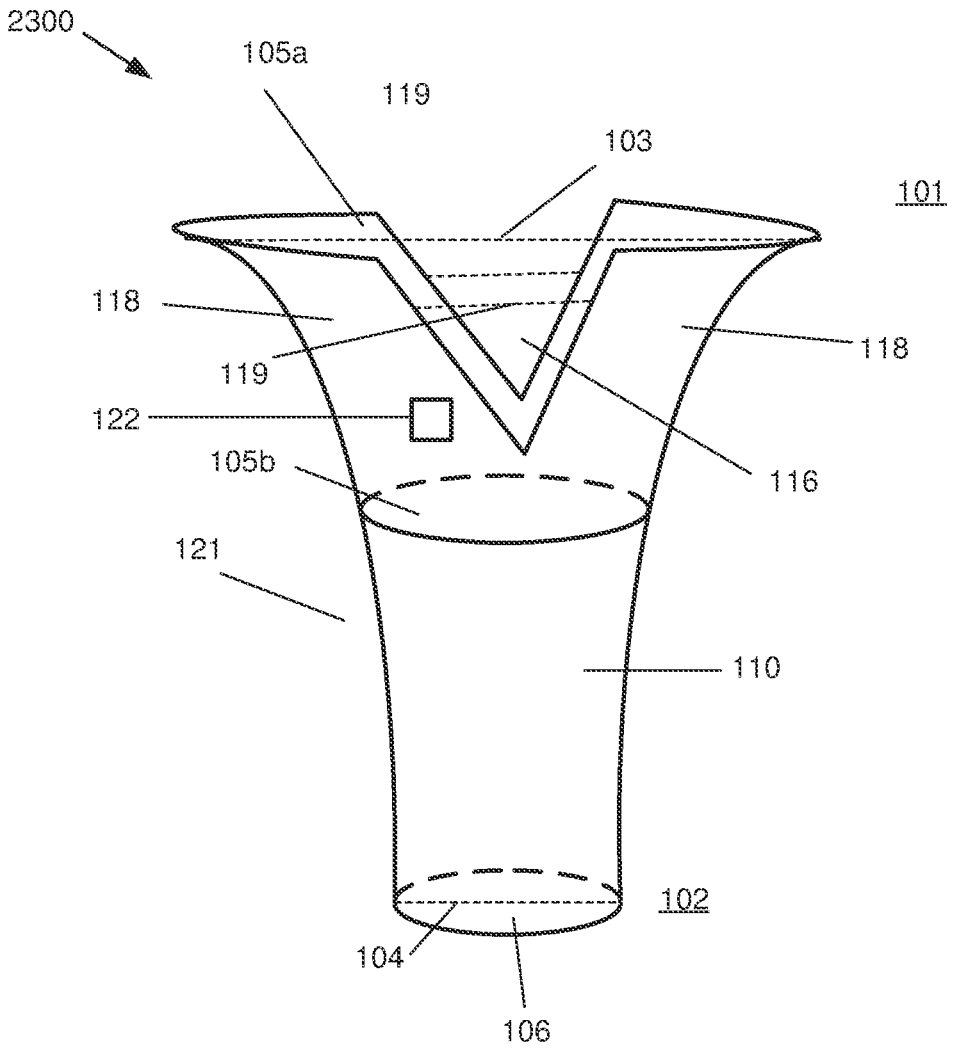
FIG. 23 illustrates a perspective view of the interface with a horn-shaped end for reception of a smokable element, where the horn-shaped end comprises at least two hinged-flaps, where the at least two hinged-flaps are open, and where at least one clip holds the at least two hinged-flaps closed, in accordance with disclosed embodiments.

Now referring to FIG. 23, a perspective view 2300 of the interface 110 with a horn-shaped end 101 for reception of a smokable element (not pictured), where the horn-shaped end 101 comprises at least two hinged-flaps 118, where the at least two hinged-flaps 118 are open 119, and where at least one clip 122 holds 409 the at least two hinged-flaps 118 closed (not pictured) is illustrated. In FIG. 23, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, where the horn-shaped end 101 of the interface 110 comprises at least two hinged-flaps 118 which can be opened 119 by an application of force 406, resulting in a deformation of the circular opening 105*a* of the horn-shaped end 101 of the interface 110 from its first cross-sectional shape (not pictured) to a second cross-sectional shape 116, which allows for insertion (not pictured) of the smokable end (not pictured) of the smokable element into the deformed circular opening 105*a* of the horn-shaped end 101 of the interface 110, and where at least one clip 122 can be removed from the at least two hinged-flaps 118 by an application of force 414 which results in allowing the at least two hinged-flaps 118 to be opened 119 by an application of force 406. It is noted that the smokable element, to be received by interface 110 at the horn-shaped end 101, may actually be received farther into the horn-shaped end 101 than the circular opening 105*a*. For example, if the smokable end of the smokable element is smaller than circular opening 105*a*, then the smokable element will be insertable to a point inside the horn-shaped end 101, e.g., to circular opening 105*b* as an alternative since the horn-shaped end narrows as the smokable element is inserted to eventually match or substantially match structural geometries to form or substantially form a seal there between, as described in a variety of further embodiments below. To further illustrate the point, and for the avoidance of doubt, the smokable element could be received to a point between circular opening 105*a* and circular opening 105*b* as well, wherever the smokable element abuts the inside of the interface 110 via the horn-shaped end 101, e.g., forms a seal, or substantial seal, with the inside of the horn-shaped end 101.

Figure 24:
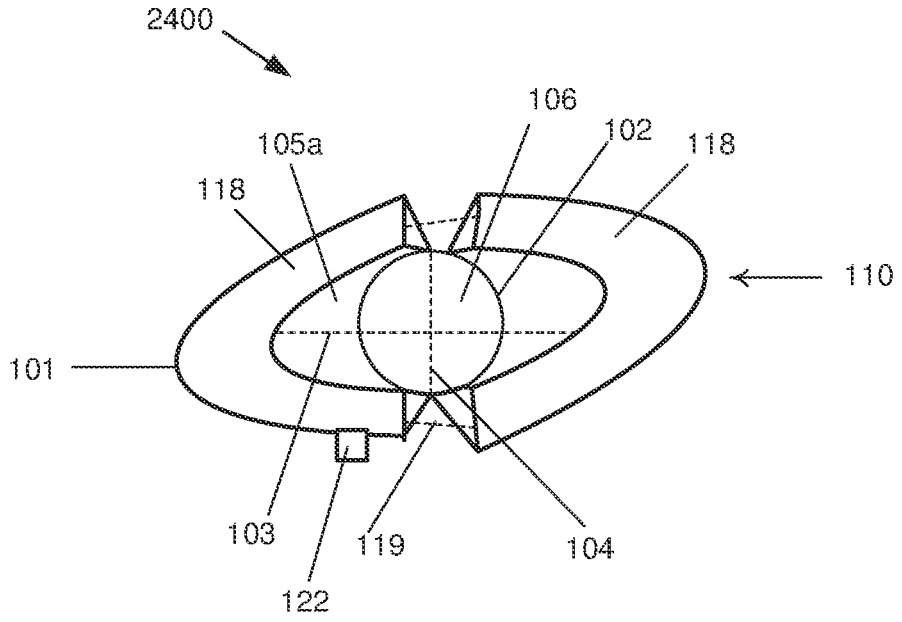
FIG. 24 illustrates a top view of the interface with a horn-shaped end for reception of a smokable element, where the horn-shaped end comprises at least two hinged-flaps, where the at least two hinged-flaps are open, and where at least one clip holds the at least two hinged-flaps closed, in accordance with disclosed embodiments.

Now referring to FIG. 24, a top view 2400 of the interface 110 with a horn-shaped end 101 for reception of a smokable element (not pictured), where the horn-shaped end 101 comprises hinged-flaps 118, where the at least two hinged-flaps 118 are open 119, and where at least one clip 122 holds 409 the at least two hinged-flaps 118 closed (not pictured) is illustrated. In FIG. 24, the circular opening 105*a* is defined by the diameter 103 and the circular opening 106 is defined by the diameter 104, as shown. The interface 110 comprises a horn-shaped end 101 with a circular opening 105*a* and a round end 102 with a circular opening 106, where the horn-shaped end 101 of the interface 110 comprises at least two hinged-flaps 118 which can be opened 119 by an application of force 406, resulting in a deformation of the circular opening 105*a* of the horn-shaped end 101 of the interface 110 from its first cross-sectional shape (not pictured) to a second cross-sectional shape 116, which allows for insertion (not pictured) of the smokable end (not pictured) of the smokable element into the deformed circular opening 105*a* of the horn-shaped end 101 of the interface 110, and where at least one clip 122 can be removed from the at least two hinged-flaps 118 by an application of force 414 which results in allowing the at least two hinged-flaps 118 to be opened 119 by an application of force 406.

Figure 25:
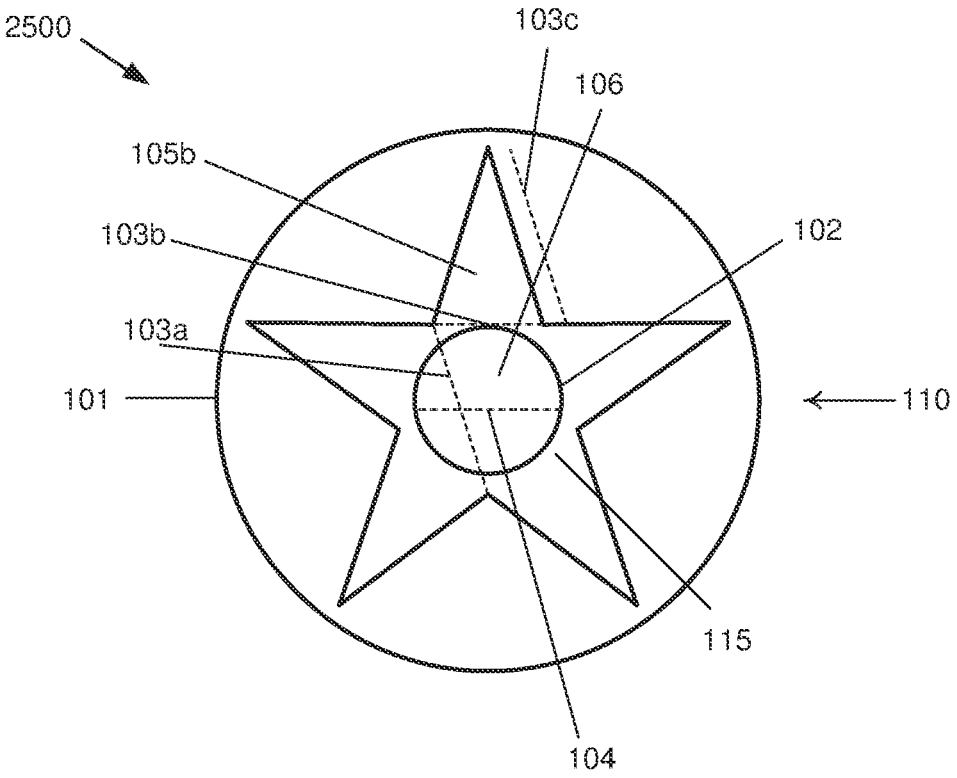
FIG. 25 illustrates a top view of the interface with a horn-shaped end for reception of a smokable element, and with an opening having a star-shaped cross section, in accordance with disclosed embodiments.

Now referring to FIG. 25, a top view 2500 of the interface 110 with a horn-shaped end 101 for reception of a smokable element (not pictured) and a round end 102 with a circular opening, where the horn-shaped end 101 has an opening 105*b* with star-shaped cross sections is illustrated. In FIG. 25, the star-shaped opening 105*b* is defined by a first distance 103*a* between two inner points of the star that are across from one another, a second distance 103*b* between two inner points of the star that are next to each another, and a third distance 103*c* between the tip of one of the arms of the star and an inner point of that arm, and the circular opening 106 is defined by the diameter 104, as shown. The interface 110 comprises a horn-shaped end 101 with an opening 105*b* and a round end 102 with a circular opening 106, where the horn-shaped end 101 and the round end 102 are opposite each other, where the opening 105*b* of the horn-shaped end 101 is larger than the circular opening 106 of the round end 102, where the opening 105*b* has star-shaped cross sections, where the star-shaped cross sections become increasingly larger moving away from the round end 102 towards the horn-shaped end 101, and where the opening 105*b* has a first cross-sectional shape 115.

Figure 26:
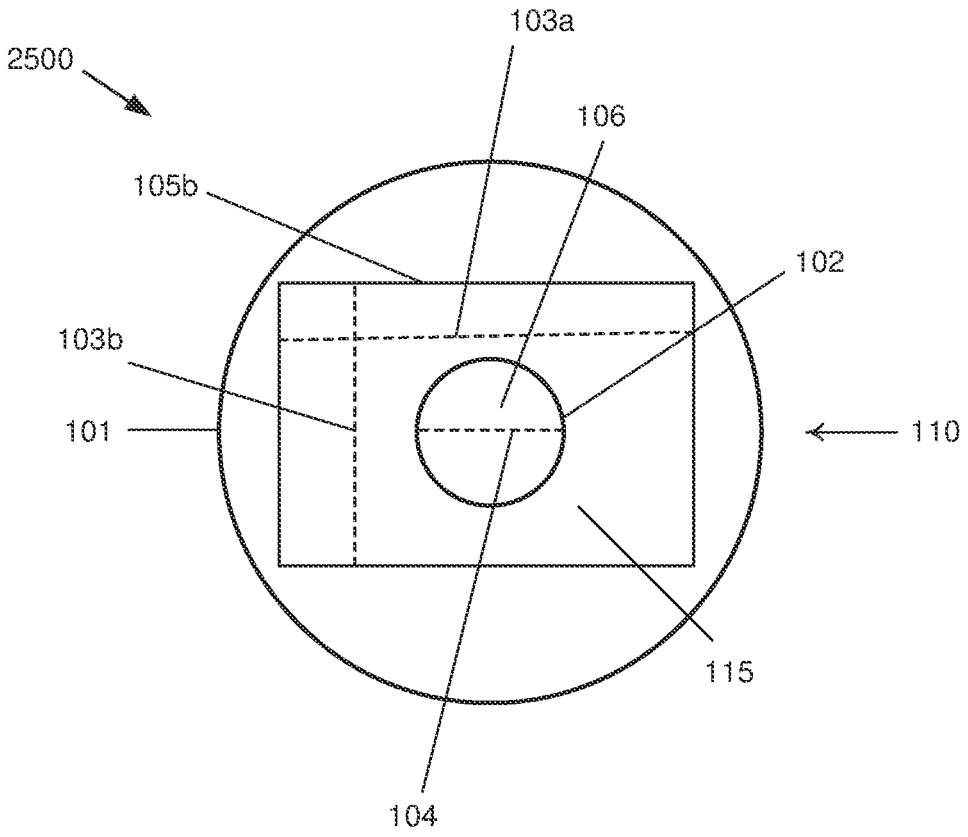
FIG. 26 illustrates a top view of the interface with a horn-shaped end for reception of a smokable element, and with an opening having a rectangle-shaped cross section, in accordance with disclosed embodiments.

Now referring to FIG. 26, a top view 2500 of the interface 110 with a horn-shaped end 101 for reception of a smokable element (not pictured) and a round end 102 with a circular opening, where the horn-shaped end 101 has an opening 105*b* with rectangular cross sections is illustrated. In FIG. 26, the rectangular opening 105*b* is defined by a first distance 103*a* between two opposite sides of the opening 105*b* and a second distance 103*b* between the other two opposite sides of the opening 105*b*, and the circular opening 106 is defined by the diameter 104, as shown. The interface 110 comprises a horn-shaped end 101 with an opening 105*b* and a round end 102 with a circular opening 106, where the horn-shaped end 101 and the round end 102 are opposite each other, where the opening 105*b* of the horn-shaped end 101 is larger than the circular opening 106 of the round end 102, where the opening 105*b* has rectangular cross sections, where the rectangular cross sections become increasingly larger moving away from the round end 102 towards the horn-shaped end 101, and where the opening 105*b* has a first cross-sectional shape 115.

Figure 27:
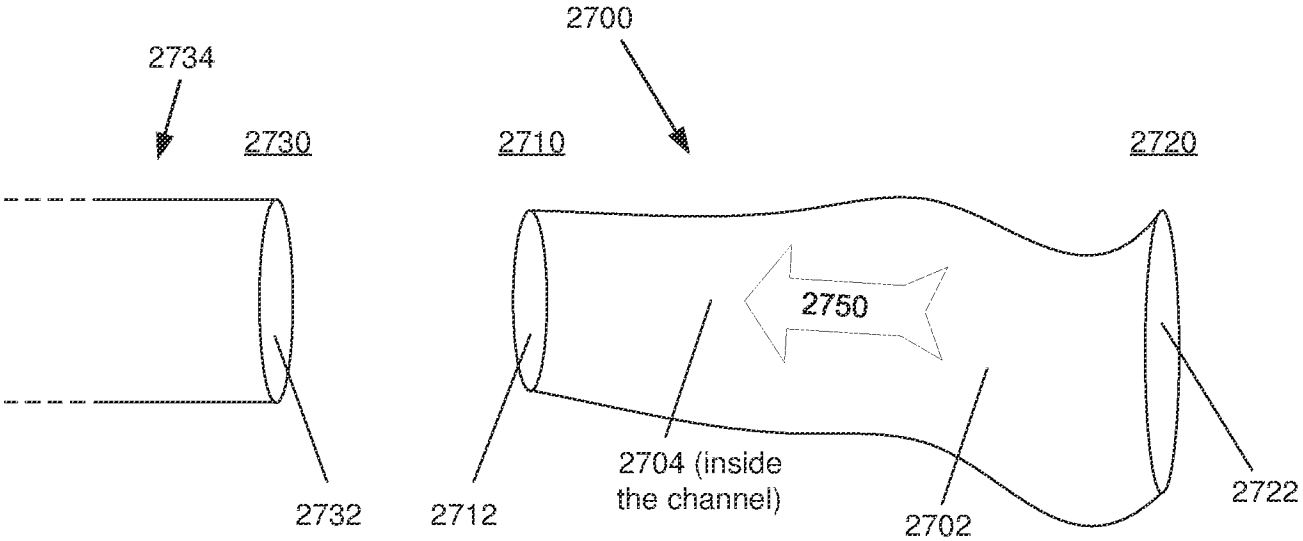
FIG. 27 illustrates a perspective view of the continuous channel defining a hollow inner chamber of an article of manufacture and an air filter, in accordance with disclosed embodiments.

Now referring to FIG. 27, a continuous channel 2702 defining a hollow inner chamber 2704 of an article of manufacture 2700 extending from a first opening 2712 at a first end 2710 of the article of manufacture 2700 to a second opening 2722 at or near a second end 2720 of the article of manufacture, wherein the second end 2710 is located opposite the first end 2710, wherein the first end 2710 of the article of manufacture 2700 is slidably insertable into a third opening 2732 of a third end 2730 of an air filter 2734, resulting in a seal, between the first end 2710 of the article of manufacture 2700 and the third end 2730 of the air filter 2734, that at least substantially restricts a flow of air 2750, between the first end 2710 of the article of manufacture 2700 and the third end 2730 of the air filter 2734, to the first opening 2710. The shape of the continuous channel 2702 can be cylindrical, rectangular, conical, or any defined shape (e.g., as shown) that enables air to flow through the continuous channel 2702, e.g., from the second opening 2722 to the first opening 2712. The example continuous channel 2702 of FIG. 7 is shown as an arbitrarily defined shape to emphasize that passage of air (e.g., the flow of air 2750) can be achieved by a wide variety of shapes and structures.

Figure 28:
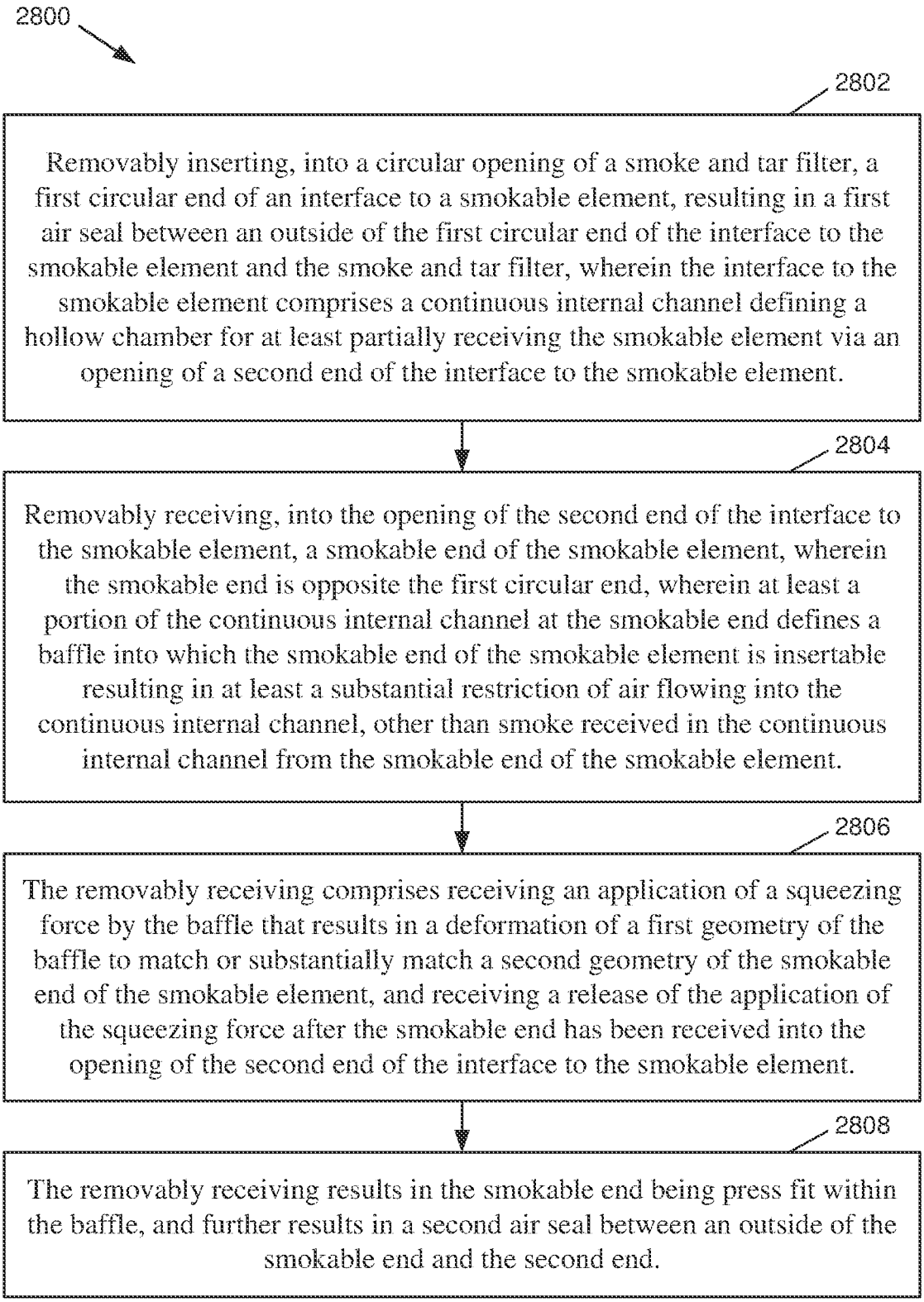
FIG. 28 illustrates a flowchart of an example method for inserting an interface to a smokable element into a smoke and tar filter, in accordance with disclosed embodiments.

Now referring to FIG. 28, an example method 2800 comprises, at 2802, removably inserting, into a circular opening of a smoke and tar filter, a first circular end of an interface to a smokable element, resulting in a first air seal between an outside of the first circular end of the interface to the smokable element and the smoke and tar filter, wherein the interface to the smokable element comprises a continuous internal channel defining a hollow chamber for at least partially receiving the smokable element via an opening of a second end of the interface to the smokable element.

Method 2800 can also comprise, at 2804, removably receiving, into the opening of the second end of the interface to the smokable element, a smokable end of the smokable element, wherein the smokable end is opposite the first circular end, wherein at least a portion of the continuous internal channel at the smokable end defines a baffle into which the smokable end of the smokable element is insertable resulting in at least a substantial restriction of air flowing into the continuous internal channel, other than smoke received in the continuous internal channel from the smokable end of the smokable element.

In this regard, the removably receiving of 2804 can comprise, at 2806, receiving an application of a squeezing force by the baffle that results in a deformation of a first geometry of the baffle to match or substantially match a second geometry of the smokable end of the smokable element, and receiving a release of the application of the squeezing force after the smokable end has been received into the opening of the second end of the interface to the smokable element.

Furthermore, at 2808, the removably receiving of 2804 results in the smokable end being press fit within the baffle, and further results in a second air seal between an outside of the smokable end and the second end.

Figure 29:
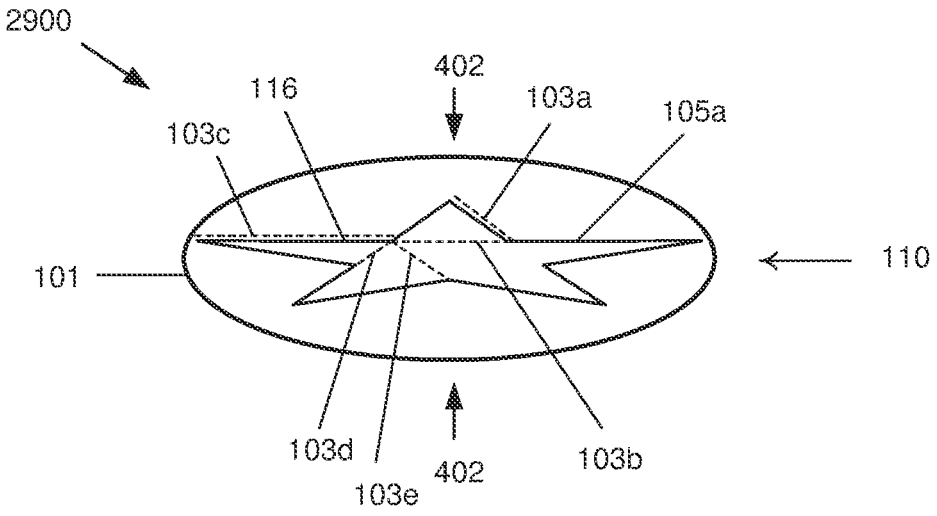
FIG. 29 illustrates a top view of an example embodiment of an interface with a horn-shaped end for reception of a smokable element, where a squeezing force is applied to the horn-shaped end of the interface, resulting in a deformation that accommodates the reception of the smokable element.

Now referring to FIG. 29, a top view 2900 of the interface 110 with a horn-shaped end 101 for reception of a smokable element (not pictured), where a squeezing force 402 is applied to the horn-shaped end 101 of the interface 110, resulting in a deformation of the first cross-sectional shape (not pictured) of the circular opening 105*b* to a second cross-sectional shape 116 which allows for insertion of the smokable end (not pictured) of the smokable element (not pictured) into the deformed star-shaped opening 105*b* of the horn-shaped end 101 of the interface 110 is illustrated. In FIG. 29, the resulting second cross-sectional shape is defined by a first distance 103*a* between the tip of an arm of the star and an inner point of the arm of the star nearest to where the squeezing force 402 is applied, a second distance 103*b* between two inner points of the star nearest to where the squeezing force 402 is applied, a third distance 103*c* between the tip of one of the arms of the star that is perpendicular to the squeezing force 402 and an inner point of that arm, a fourth distance 103*d* between two inner points of an arm of the star that is perpendicular to the squeezing force 402, and a fifth distance 103*e* between two inner points of the star that are across from each other, as shown. The interface 110 comprises a horn-shaped end 101 with an opening 105*b* and a round end (not pictured) with a circular opening (not pictured), where the horn-shaped end 101 and the round end are opposite each other, where the opening 105*b* of the horn-shaped end 101 is larger than the circular opening of the round end, where the opening 105*b* has star-shaped cross sections, where the star-shaped cross sections become increasingly larger moving away from the round end towards the horn-shaped end 101, and where the opening 105*b* has a second cross-sectional shape 116.

Figure 30:
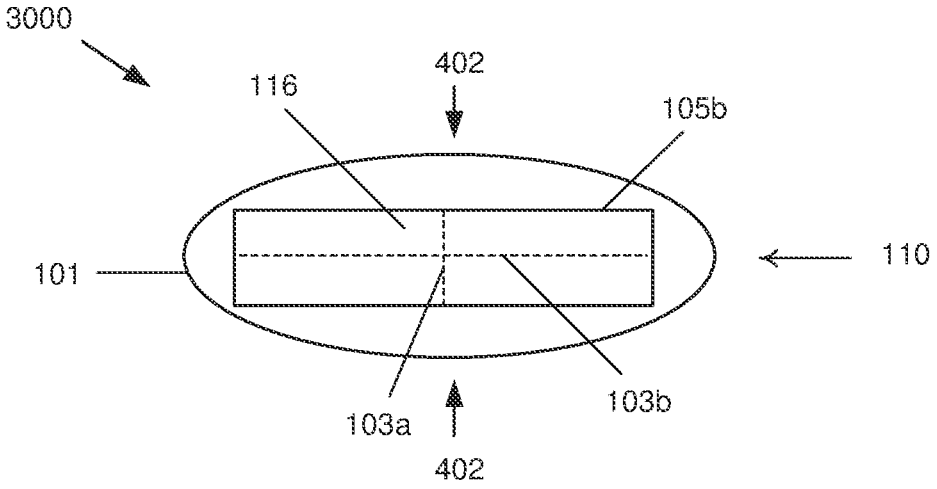
FIG. 30 illustrates a top view of another example embodiment of an interface with a horn-shaped end for reception of a smokable element, where a squeezing force is applied to the horn-shaped end of the interface, resulting in a deformation that accommodates the reception of the smokable element.

Now referring to FIG. 30, a top view 3000 of the interface 110 with a horn-shaped end 101 for reception of a smokable element (not pictured), where a squeezing force 402 is applied to the horn-shaped end 101 of the interface 110, resulting in a deformation of the first cross-sectional shape (not pictured) of the opening 105*b* to a second cross-sectional shape 116 which allows for insertion of the smokable end (not pictured) of the smokable element (not pictured) into the deformed star-shaped opening 105*b* of the horn-shaped end 101 of the interface 110 is illustrated. In FIG. 30, the resulting second cross-sectional shape is defined by a first distance 103*a* two opposite sides of the opening 105*b* and a second distance 103*b* between the other two opposite sides of the opening 105*b*, as shown. The interface 110 comprises a horn-shaped end 101 with an opening 105*b* and a round end (not pictured) with a circular opening (not pictured), where the horn-shaped end 101 and the round end are opposite each other, where the opening 105*b* of the horn-shaped end 101 is larger than the circular opening of the round end, where the opening 105*b* has star-shaped cross sections, where the star-shaped cross sections become increasingly larger moving away from the round end towards the horn-shaped end 101, and where the opening 105*b* has a second cross-sectional shape 116.

Figure 31:
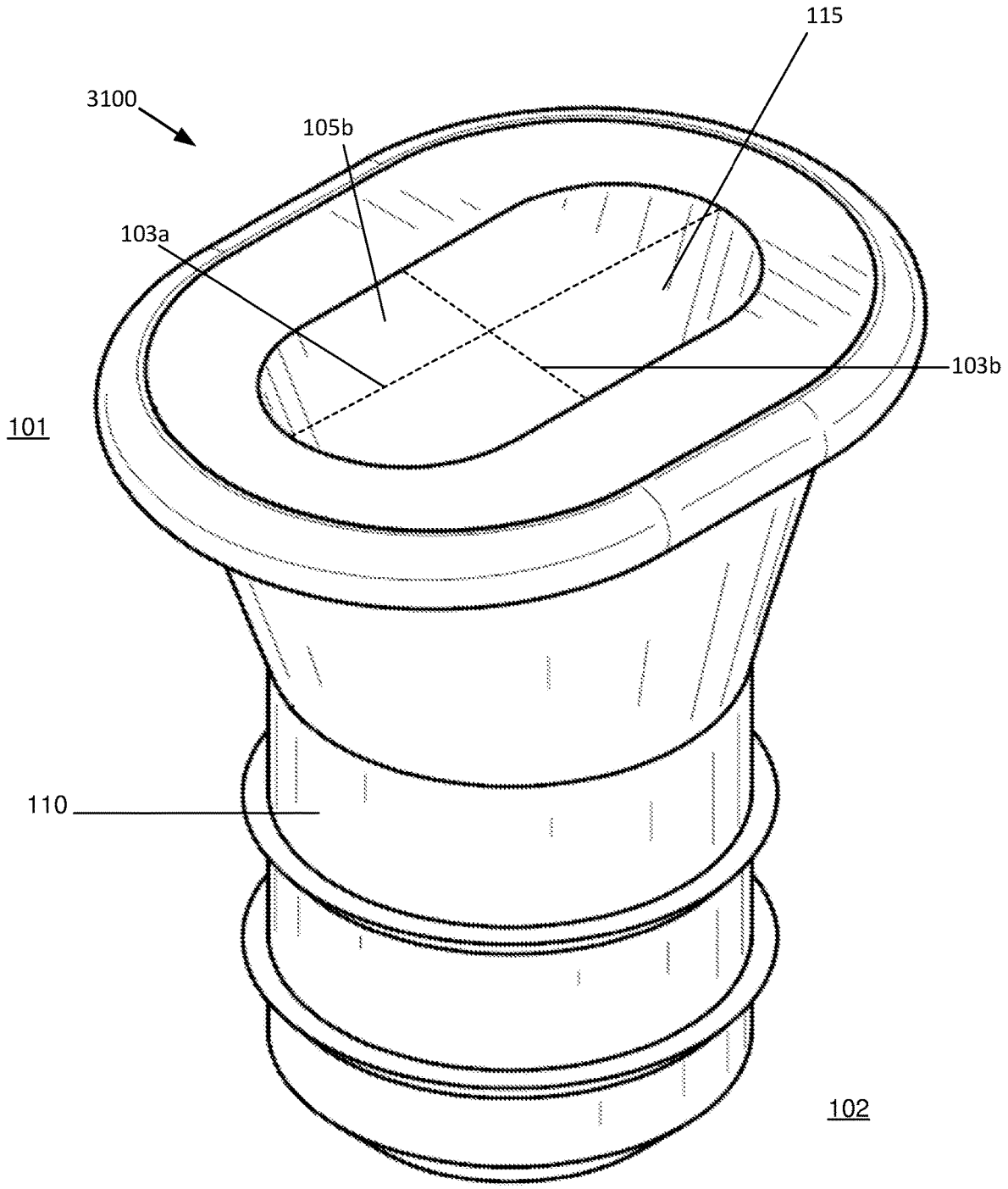
FIG. 31 illustrates a perspective view of an example embodiment of the interface with a horn-shaped end for reception of a smokable element, in accordance with disclosed embodiments.

Now referring to FIG. 31, a perspective view 3100 of an example embodiment of the interface 110 with a horn-shaped end 101 for reception of a smokable element (not pictured) and a round end 102 with a circular opening (not pictured), where the horn-shaped end 101 has an opening 105*b* with oval-shaped cross sections, is illustrated. In FIG. 31, the oval-shaped opening 105*b* is defined by a first distance 103*a* between two opposite sides of the opening 105*b* and a second distance 103*b* between the other two opposite sides of the opening 105*b*. The interface 110 comprises a horn-shaped end 101 with an opening 105*b* and a round end 102 with a circular opening, where the horn-shaped end 101 and the round end 102 are opposite each other, where the opening 105*b* of the horn-shaped end 101 is larger than the circular opening of the round end 102, where the opening 105*b* has oval-shaped cross sections, where the oval-shaped cross sections become increasingly larger moving away from the round end 102 towards the horn-shaped end 101, and where the opening 105*b* has a first cross-sectional shape 115.

Figure 32:
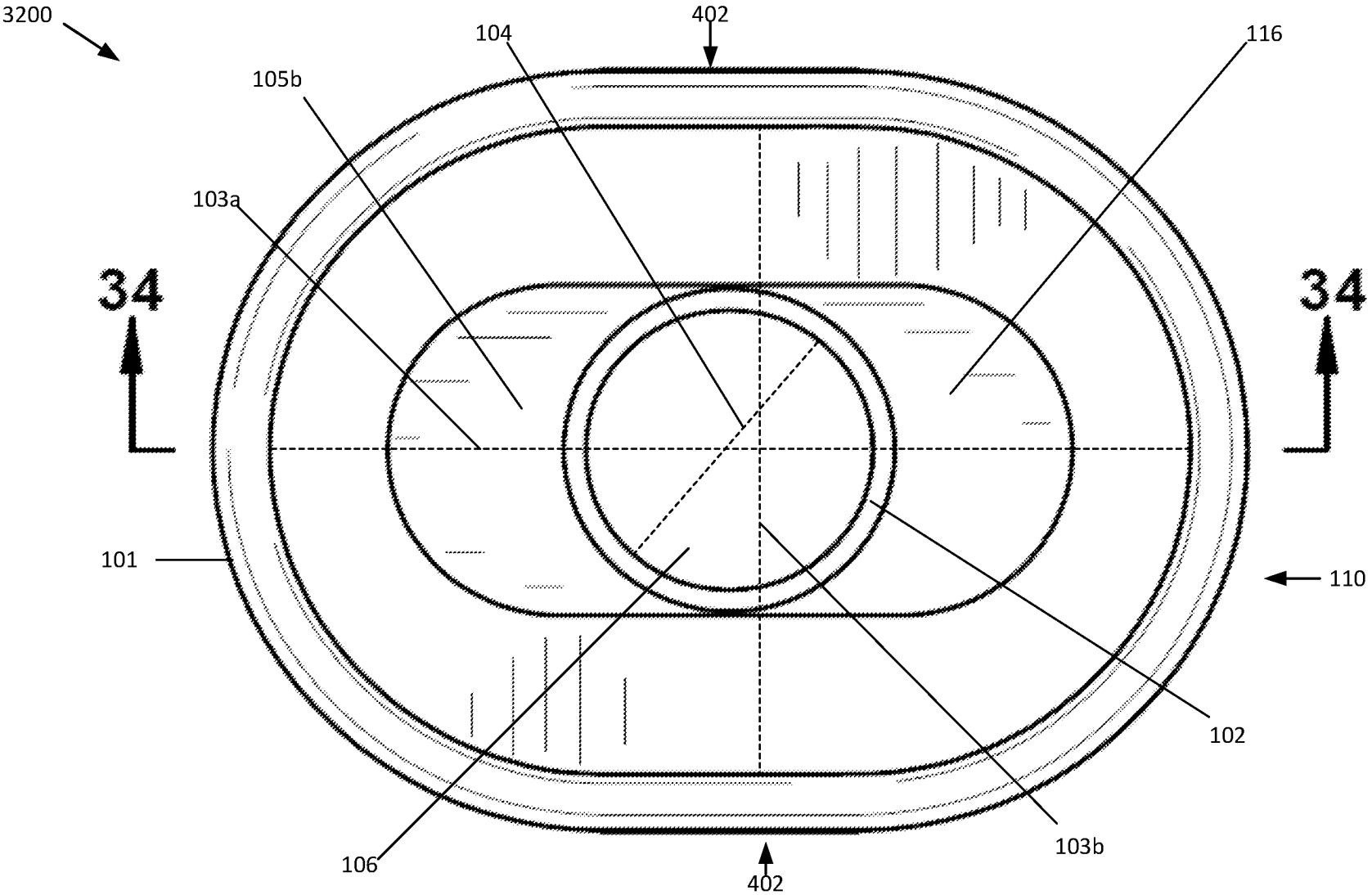
FIG. 32 illustrates a top view of the interface with a horn-shaped end for reception of a smokable element, when a squeezing force is applied to the horn-shaped end, in accordance with disclosed embodiments.

Now referring to FIG. 32, a top view 3200 of an example embodiment of the interface 110 with a horn-shaped end 101 for reception of a smokable element (not pictured), where a squeezing force 402 is applied to the horn-shaped end 101 of the interface 110, resulting in a deformation of the first cross-sectional shape (not pictured) of the oval-shaped opening 105*b* to a second cross-sectional shape 116 which allows for insertion of the smokable end (not pictured) of the smokable element into the deformed oval-shaped opening 105*b* of the horn-shaped end 101 of the interface 110 is illustrated. In FIG. 32, the oval-shaped opening 105*b* is defined by a first distance 103*a* between two opposite sides of the opening 105*b* and a second distance 103*b* between the other two opposite sides of the opening 105*b*. The interface 110 comprises the horn-shaped end 101 with the oval-shaped opening 105*a* and a round end 102 with a circular opening 106, where the horn-shaped end 101 and the round end 102 are opposite each other, where the horn-shaped end 101 is larger than the round end 102, where the circular opening 106 is defined by its diameter 104, and where the opening 105*b* of the horn-shaped end 101 has a cross-sectional shape 116.

Figure 33:
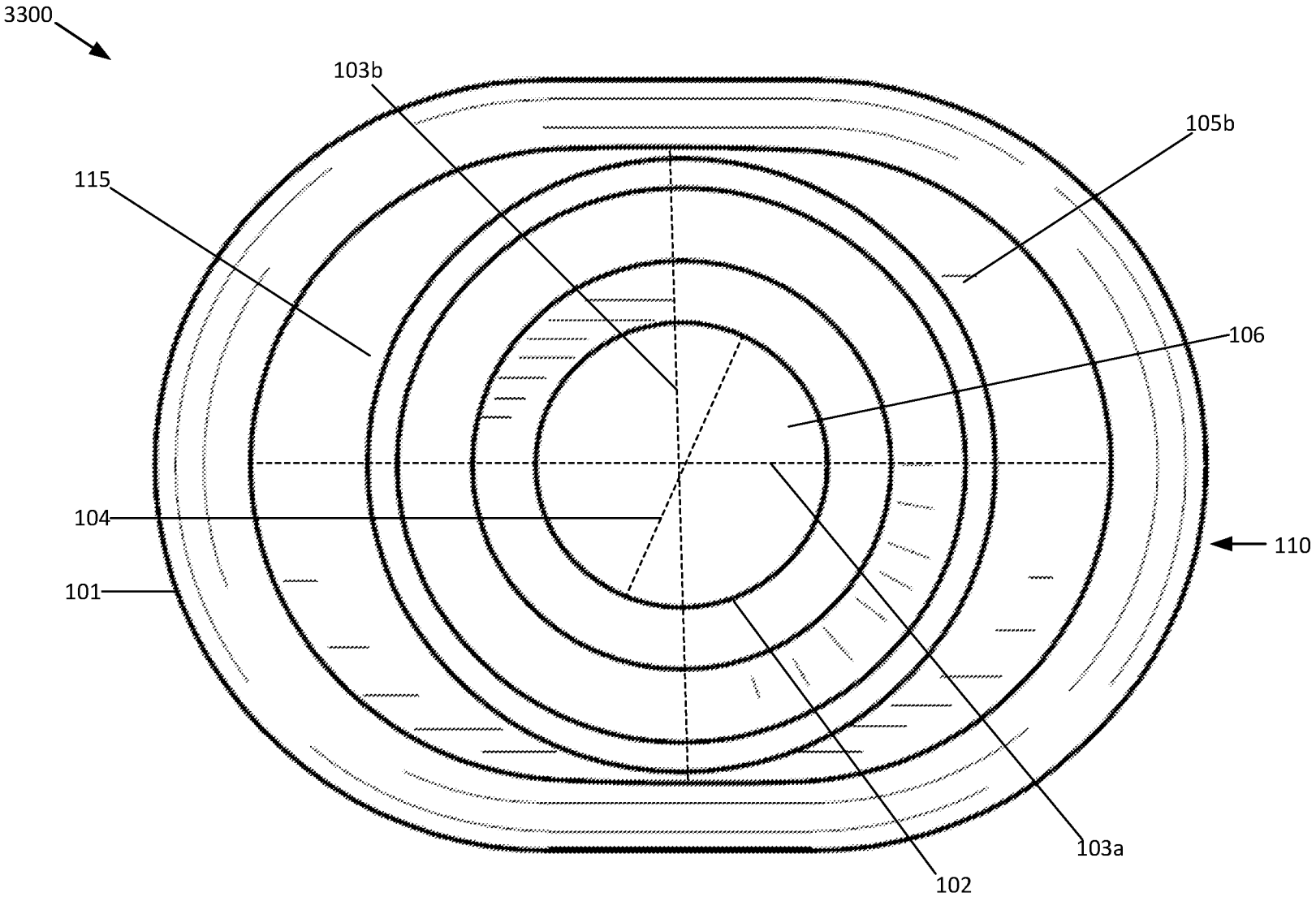
FIG. 33 illustrates a top view of the interface with a horn-shaped end for reception of a smokable element, in accordance with disclosed embodiments.

Now referring to FIG. 33, a top view 3300 of the an example embodiment of the interface 110 with a horn-shaped end 101 for reception of a smokable element (not pictured) is illustrated. In FIG. 33, the oval-shaped opening 105*b* is defined by a first distance 103*a* between two opposite sides of the opening 105*b* and a second distance 103*b* between the other two opposite sides of the opening 105*b*. The interface 110 comprises the horn-shaped end 101 with the oval-shaped opening 105*b* and the round end 102 with the circular opening 106, where the horn-shaped end 101 and the round end 102 are opposite each other, where the circular opening 106 is defined by its diameter 104, where the horn-shaped end 101 is larger than the round end 102, and where the opening 105*b* of the horn-shaped end 101 has a cross-sectional shape 115.

Figure 34:
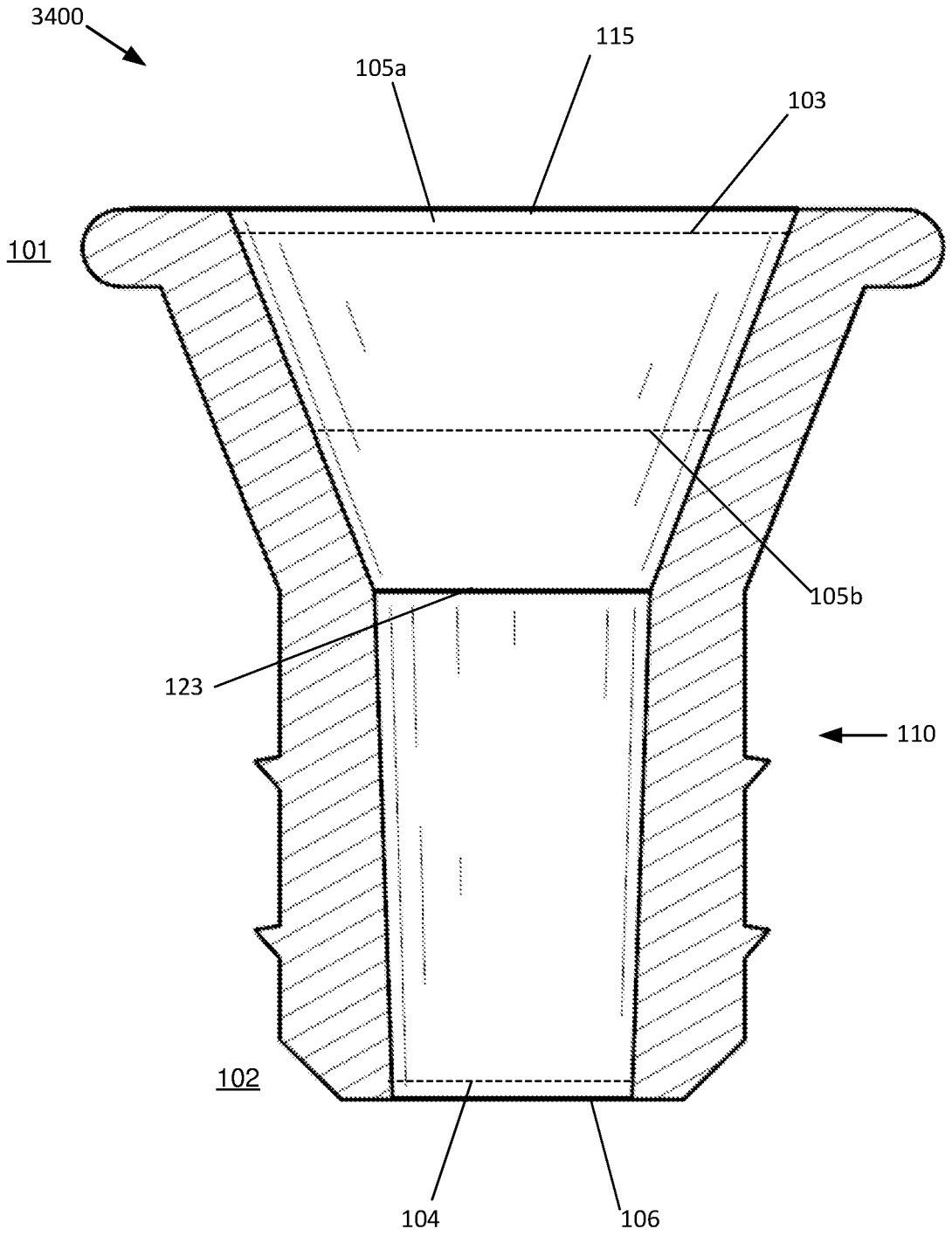
FIG. 34 illustrates a cross-sectional, side view of an example embodiment of the interface with a horn-shaped end for reception of a smokable element, in accordance with disclosed embodiments.

Now referring to FIG. 34, a cross-sectional, side view of an example embodiment of the interface 110 with a horn-shaped end 101 for reception of a smokable element (not pictured) is illustrated. The interface 110 comprises the horn-shaped end 101 with an opening 105*a* and a round end 102 with a circular opening 106, where the horn-shaped end 101 and the round end 102 are opposite each other, where the circular opening 106 is defined by its diameter 104, where the horn-shaped end 101 is larger than the round end 102, where the opening 105*a* is defined by a first distance 103*a* between two opposite sides of the opening 105*a* and a second distance (not shown) between the other two opposite sides of the opening 105*a*, where the opening 105*a* of the horn-shaped end 101 has a cross-sectional shape 115, and where the cross-sectional shape is the same at every point between the edge of the opening 105*a* and the point 123 where the opening 105*a* meets the circular opening 106. It is noted that the smokable element, to be received by interface 110 at the horn-shaped end 101, may actually be received farther into the horn-shaped end 101 than the circular opening 105*a*. For example, if an end of the smokable element is smaller than circular opening 105*a*, then the smokable element will be insertable to a point inside the horn-shaped end 101, e.g., to an opening 105*b* as an alternative since the horn-shaped end narrows as the smokable element is inserted to eventually match or substantially match structural geometries to form or substantially form a seal there between, as described in a variety of further embodiments below. To further illustrate the point, and for the avoidance of doubt, the smokable element could be received to a point between opening 105*a* and circular opening 105*b* as well, wherever the smokable element abuts the inside of the interface 110 via the horn-shaped end 101, e.g., forms a seal, or substantial seal, with the inside of the horn-shaped end 101. It should also be noted the cross-sectional shape 115 can be any shape suited to the carriage of air, such as circular, star-shaped, rectangular, square, polygonal, U-shaped, etc.

Figure 35:
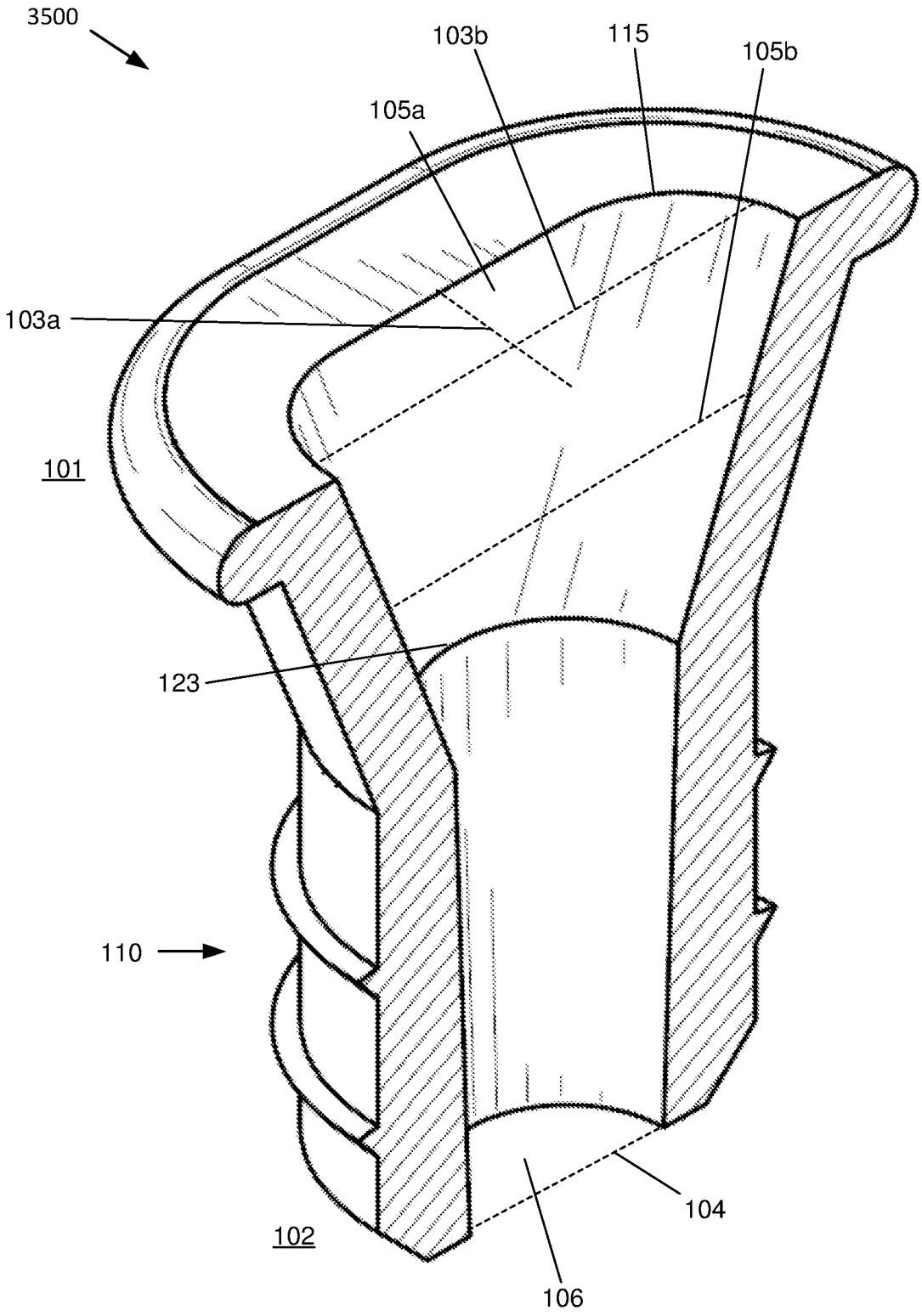
FIG. 35 illustrates a cross-sectional, perspective view of an example embodiment of the interface with a horn-shaped end for reception of a smokable element, in accordance with disclosed embodiments.

Now referring to FIG. 35, a cross-sectional, perspective view of an example embodiment of the interface 110 with a horn-shaped end 101 for reception of a smokable element (not pictured) is illustrated. The interface 110 comprises the horn-shaped end 101 with an oval-shaped opening 105*a* and a round end 102 with a circular opening 106, where the horn-shaped end 101 and the round end 102 are opposite each other, where the circular opening 106 is defined by its diameter 104, where the horn-shaped end 101 is larger than the round end 102, where the oval-shaped opening 105*a* is defined by a first distance 103*a* between two opposite sides of the oval-shaped opening 105*a* and a second distance 103*b* between the other two opposite sides of the oval-shaped opening 105*a*, where the oval-shaped opening 105*a* of the horn-shaped end 101 has a cross-sectional shape 115, and where the cross-sectional shape is the same at every point between the edge of the oval-shaped opening 105*a* and the point 123 where the oval-shaped opening 105*a* meets the circular opening 106. It is noted that the smokable element, to be received by interface 110 at the horn-shaped end 101, may actually be received farther into the horn-shaped end 101 than the circular opening 105*a*. For example, if an end of the smokable element is smaller than circular opening 105*a*, then the smokable element will be insertable to a point inside the horn-shaped end 101, e.g., to an opening 105*a* as an alternative since the horn-shaped end narrows as the smokable element is inserted to eventually match or substantially match structural geometries to form or substantially form a seal there between, as described in a variety of further embodiments below. To further illustrate the point, and for the avoidance of doubt, the smokable element could be received to a point between opening 105*a* and opening 105*b* as well, wherever the smokable element abuts the inside of the interface 110 via the horn-shaped end 101, e.g., forms a seal, or substantial seal, with the inside of the horn-shaped end 101. It should also be noted the cross-sectional shape 115 can be any shape suited to the carriage of air, such as circular, star-shaped, rectangular, square, polygonal, U-shaped, etc.

In addition, the word "example" or "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What has been described above includes examples of the present specification. It is, of course, not possible to describe every conceivable combination of components or methods for purposes of describing the present specification, but one of ordinary skill in the art may recognize that many further combinations and permutations of the present specification are possible. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

Those skilled in the art will recognize that, unless specifically indicated or required by the sequence of operations, certain steps in the processes described above may be omitted, performed concurrently or sequentially, or performed in a different order.

Although an exemplary embodiment of the present disclosure has been described in detail, those skilled in the art will understand that various changes, substitutions, variations, and improvements disclosed herein may be made without departing from the spirit and scope of the disclosure in its broadest form.

What is claimed is:

1. A system, comprising:

an air filter comprising an opening; and an interface component configured to interface with a smokable element to the air filter, wherein the interface component comprises a continuous horn-shaped channel defining a hollow inner chamber extending from a first end of the interface component to at least near a second end of the interface component, wherein part of the interface component near the second end is inserted into the opening of the air filter, wherein the interface component is coupled with the air filter to permit a flow of air through the hollow inner chamber of the interface component and the opening in the air filter, wherein the interface component comprises an elastomeric material that configures the interface component to be deformable from a first shape to a second shape that permits insertion of the smokable element into an opening at the first end of the interface component in response to receipt of a squeezing force, and to be deformable to a third shape that yields a press fit with the smokable element in response to release of the squeezing force while the smokable element is inserted into the opening at the first end of the interface component, wherein application of a rotating force to a knob of the interface component causes the squeezing force to be applied to the opening at the first end of the interface component, and wherein the squeezing force results in a change to a cross-sectional shape of the opening at the first end of the interface component.

2. The system of claim 1, wherein the second end of the interface component is coupled with the air filter.

3. The system of claim 1, wherein a seal formed between the air filter and a corresponding part of the interface component facilitates the flow of air through the hollow inner chamber of the interface component and the opening in the air filter.

4. The system of claim 1, wherein while the interface component is in the first shape, the opening at the first end of the interface component has an oblong shape or an oval shape, and while the interface component is in the second shape, the opening at the first end of the interface component is substantially circular.

5. The system of claim 1, wherein a first area defined by the opening at the first end of the interface component is larger than a second area defined by an opening at the second end of the interface component that interfaces with the opening in the air filter.

6. The system of claim 1, wherein the second end of the interference component is configured to form another press fit with the opening in the air filter.

7. The system of claim 1, wherein the press fit yields a seal between the smokable element and the first end of the interface component.

8. The system of claim 7, wherein the seal is a partial seal that causes a mixture of smoke from the smokable element and external air to be received through the opening at the first end of the interface component and conveyed to the opening in the air filter via the horn-shaped channel.

9. The system of claim 8, wherein the interface component further comprises a twistable knob that, in response to application of a rotating force, adjusts an amount of the external air that enters the opening at the first end of the interface component.

10. The system of claim 1, wherein the air filter is at least one of a smoke filter or a tar filter.

11. The system of claim 1, wherein, while the interface component is in the first shape, the opening at the first end of the interface component has one of an oval shape, a star shape, or a rectangular shape.

12. A method, comprising:

coupling a first end of an interface component with an air filter, wherein the interface component comprises a continuous horn-shaped internal channel defining a hollow inner chamber extending from a second end of the interface component to at least near the first end of the interface component, and wherein part of the interface component at the first end is inserted into the opening of the air filter;

removably receiving, into an opening of the second end of the interface component, an end of a smokable element, wherein at least a portion of the continuous horn-shaped internal channel at the second end defines a baffle into which the smokable end of the smokable element is insertable, and wherein the removably receiving comprises:

deforming the interface component, via an application of a squeezing force, to yield a first geometry of the baffle that permits insertion of the end of the smokable element into the opening of the second end of the interface component, and deforming the interface component, via a release of the application of the squeezing force while the end of the smokable element is received into the opening of the second end of the interface component, to yield a second geometry of the baffle that yields a press fit with the smokable element, wherein application of a rotating force to a knob of the interface component causes the squeezing force to be applied to the opening at the second end of the interface component, and wherein the squeezing force being applied changes a cross-sectional geometry of the opening at the second end of the interface component from the second geometry to the first geometry.

13. The method of claim 12, wherein the coupling causes a seal to be formed between the air filter and the interface component, and the seal facilitates a flow of air through the hollow inner chamber of the interface component and an opening in the air filter.

14. The method of claim 12, wherein the press fit creates a seal between the smokable element and the second end of the interface component.

15. The method of claim 14, wherein the seal is a partial seal that facilitates receipt of a mixture of smoke from the smokable element and external air through the opening at the second end of the interface component.

16. The method of claim 15, further comprising, in response to application of a rotating force to a twistable knob of the interface component, adjusting an amount of the external air that enters the opening at the second end of the interface component.

17. An apparatus, comprising:

an interface component configured to convey smoke from a smokable element to an opening of an air filter via a hollow inner chamber that traverses from a first end of the interface component to at least near a second end of the interface component, wherein a part of the interface component comprising the second end is inserted into the opening of the air filter, the part of the interface component excludes the first end of the interface component, the interface component is made of an elastomeric material, at least a portion of the hollow inner chamber comprising a continuous horn-shaped channel, and the interface component is configured to be deformable, in response to receipt of a squeezing force, from a first shape to a second shape that permits insertion of the smokable element into an opening at the first end of the interface component, and to be deformable, in response to release of the squeezing force while the smokable element is inserted into the opening at the first end of the interface component, to a third shape that yields a press fit with the smokable element, wherein application of a rotating force to a knob of the interface component causes the squeezing force to be applied to the interface component, and wherein the squeezing force changes a cross-sectional shape of the interface component from the first shape to the second shape.

18. The apparatus of claim 17, wherein while the interface component is in the first shape, the opening at the first end of the interface component has an oblong shape or an oval shape, and while the interface component is in the second shape, the opening at the first end of the interface component is circular or substantially circular.

19. The apparatus of claim 18, wherein the second end of the interference component is configured to form a press fit with the opening in the air filter.

20. The apparatus of claim 18, wherein, while the interface component is in the first shape, the opening at the first end of the interface component has the oval shape.

* * * * *